US007497557B2

(12) United States Patent
Sugahara

(10) Patent No.: US 7,497,557 B2
(45) Date of Patent: Mar. 3, 2009

(54) LIQUID EJECTING APPARATUS, METHOD FOR MANUFACTURING LIQUID EJECTING APPARATUS, AND INK-JET PRINTER

(75) Inventor: Hiroto Sugahara, Ama-gun (JP)

(73) Assignee: Brother Kogyo Kabushiki Kaisha (JP)

( * ) Notice: Subject to any disclaimer, the term of this patent is extended or adjusted under 35 U.S.C. 154(b) by 427 days.

(21) Appl. No.: 11/232,971

(22) Filed: Sep. 23, 2005

(65) Prior Publication Data

US 2006/0066685 A1 Mar. 30, 2006

(30) Foreign Application Priority Data

Sep. 24, 2004 (JP) ..... 2004-277720
Sep. 24, 2004 (JP) ..... 2004-277721

(51) Int. Cl.
*B41J 2/045* (2006.01)

(52) U.S. Cl. ..... 347/68; 347/70

(58) Field of Classification Search ..... 347/68, 347/70–72

See application file for complete search history.

(56) References Cited

U.S. PATENT DOCUMENTS 6,231,169 B1 * 5/2001 Yazaki et al. ..... 347/70
6,328,435 B1 12/2001 Ono et al.
6,616,270 B1 * 9/2003 Miyata et al. ..... 347/68
6,758,554 B2 * 7/2004 Kamei et al. ..... 347/70
2003/0063137 A1 4/2003 Kamei et al.
2004/0113994 A1 6/2004 Shinkai

FOREIGN PATENT DOCUMENTS

EP 0855274 A2 7/1998
EP 1101615 A1 5/2001
JP 2000-43265 2/2000
JP 2000-289201 A 10/2000
JP 2003-205617 7/2003
JP 2004-136663 5/2004

OTHER PUBLICATIONS

Extended European Search Report dated Jan. 30, 2007 in Application No. EP 05 020 818.0.

* cited by examiner

*Primary Examiner*—An H Do
(74) *Attorney, Agent, or Firm*—Banner & Witcoff, Ltd.

(57) ABSTRACT

An ink-jet head includes a common liquid chamber, a plurality of pressure chambers, a plurality of nozzles which eject ink, a plurality of individual ink channels communicating with the common liquid chamber, the pressure chambers and the nozzles, and a piezoelectric actuator which selectively varies the volume of the plurality of pressure chambers. The common liquid chamber is disposed on the side opposite to the nozzles with respect to the piezoelectric actuator. A through-hole which forms a part of the individual ink channels is formed in the piezoelectric actuator. This structure ensures a large region in which the nozzles can be disposed, and allows the nozzles to be arranged at higher density.

22 Claims, 23 Drawing Sheets

LIQUID EJECTING APPARATUS, METHOD FOR MANUFACTURING LIQUID EJECTING APPARATUS, AND INK-JET PRINTER

BACKGROUND OF THE INVENTION

1. Field of the Invention

The present invention relates to a liquid ejecting apparatus which ejects a liquid, to a method for manufacturing a liquid ejecting apparatus, and to an ink-jet printer which ejects ink.

2. Description of the Related Art

An example of a liquid ejecting apparatus which ejects a liquid is an ink-jet head which ejects ink from a nozzle as disclosed in U.S. Patent Application Publication No. US 2004/113994 A1 corresponding to Japanese Patent Application Laid-Open 2004-136663, and particularly in FIG. 6. There is a known type of such apparatus which has individual ink channels extending from a manifold through pressure chambers to nozzles, and an actuator which applies pressure to the ink inside the pressure chambers. In such an ink-jet head, the actuator is provided so as to cover the pressure chambers, while the manifold and the nozzles are formed on a side opposite to the actuator in relation to the pressure chambers. When the actuator applies pressure to the ink inside a pressure chamber, the ink is ejected out of the nozzle communicating with this pressure chamber.

SUMMARY OF THE INVENTION

There has been a need in recent years for a plurality of nozzles to be arranged at higher density in order to improve the quality of printed images and to make an ink-jet head more compact. Because an ink-jet head is moved by a carriage within the housing of an ink-jet printer, the size of the head affects the design of the printer and the size of the housing.

It is an object of the present invention to provide a liquid ejecting apparatus and an ink-jet printer with which the region in which the nozzles can be disposed can be kept large, and a plurality of nozzles can be disposed at high density.

According to a first aspect of the present invention, there is provided a liquid ejecting apparatus, comprising a common liquid chamber; a plurality of pressure chambers disposed along a plane; a plurality of nozzles which eject liquid; a plurality of individual liquid channels which respectively extend from the common liquid chamber through the pressure chambers to the nozzles; and an actuator which is disposed across from or so as to face the plurality of pressure chambers to selectively vary a volume of the plurality of pressure chambers, wherein the common liquid chamber is disposed on a side opposite to the nozzles with respect to the actuator, and the actuator has a first through-hole which forms a part of the individual liquid channels.

In this liquid ejecting apparatus, the actuator selectively varies the volume of the pressure chambers, which applies pressure to the liquid inside the pressure chambers and ejects the liquid out of the nozzles communicating with the pressure chambers. Here, the nozzles and common liquid chamber which constructs the individual liquid channels are disposed on opposite sides in relation to the actuator, and the individual liquid channels go through or penetrate the actuator at the first through-hole. When the common liquid chamber is thus disposed on a side opposite to the nozzles in relation to the actuator, the region in which the nozzles can be disposed can be larger than when the nozzles and the common liquid chamber are disposed on the same side, as with a conventional ink-jet head. Accordingly, the nozzles can be disposed at higher density.

In the liquid ejecting apparatus of the present invention, the actuator may extend along the plane. Therefore, the common liquid chamber and the nozzles are disposed on both sides with the actuator extending in the plane intervening therebetween, and the individual liquid channels penetrate the actuator at the first through-hole.

In the liquid ejecting apparatus of the present invention, the common liquid chamber, as viewed in a direction perpendicular to the plane, may be disposed in a region which overlaps the nozzles and the pressure chambers. When the pressure has been applied to the liquid in a certain pressure chamber by the actuator, a phenomenon called fluid crosstalk may occur, whereby the pressure waves propagate through the common liquid chamber to another pressure chamber, and this results in variance in the ejection characteristics from a plurality of nozzles. With the present invention, however, the common liquid chamber is disposed in a region which overlaps the nozzles and the pressure chambers, so the common liquid chamber has greater surface area (the surface area projected in a direction perpendicular to the plane in which the plurality of pressure chambers are disposed). Accordingly, the volume of the common liquid chamber can be larger, which effectively attenuates pressure wave propagation from the pressure chambers to the common liquid chamber, and suppresses crosstalk. Alternatively, if the surface area of the common liquid chamber is increased, its height can be reduced while maintaining the same volume, so a more compact liquid ejecting apparatus can be achieved.

In the liquid ejecting apparatus of the present invention, the actuator may have a vibration plate disposed over the plurality of pressure chambers, a piezoelectric layer disposed on a side of the vibration plate opposite to the pressure chambers, and a plurality of individual electrodes each disposed corresponding to one of the plurality of pressure chambers on the side of the vibration plate opposite to the pressure chambers. In this case, the common liquid chamber may be disposed on a side opposite to the pressure chambers with respect to the actuator, a protective plate which protects the actuator may be provided between the piezoelectric layer and the common liquid chamber, and the protective plate may have a second through-hole which forms a part of the individual liquid channels. Since the actuator is thus protected by the protective plate, the actuator does not come into direct contact with the liquid inside the common liquid chamber. Also, in particular, if the liquid is electrically conductive, short-circuiting between the individual electrodes when this conductive liquid permeates the actuator is kept to an absolute minimum. Furthermore, since the common liquid chamber is disposed on the side opposite to the pressure chambers with respect to the actuator, and the pressure chambers and nozzles are disposed on the same side, the distance from the pressure chambers to the nozzles can be shorter. In this case, the drive voltage applied to the individual electrodes can be lowered when the piezoelectric layer and vibration plate are deformed so as to vary the volume of the pressure chambers, which improves the actuator drive efficiency.

In the liquid ejecting apparatus of the present invention, the protective plate may have a thick-walled portion which is joined to the actuator, and a thin-walled portion which is apart from the actuator, and the thin-walled portion may be disposed to form a space between the thin-walled portion and a portion of the actuator which faces the pressure chambers. Since the thin-walled portion is thus disposed to form a space between the individual electrodes and the thin-walled portion of the protective plate, when drive voltage is applied to a certain individual electrode and the portion of the piezoelectric layer corresponding to that individual electrode is deformed, this deformation of the piezoelectric layer will not be hindered by the protective plate. Therefore, the protective plate is able to protect the actuator while preventing a decrease in the drive efficiency of the actuator.

In the liquid ejecting apparatus of the present invention, the thin-walled portion of the protective plate may function as a damper which absorbs pressure fluctuations in the common liquid chamber. Therefore, the thin-walled portion of the protective plate can reduce fluid crosstalk by absorbing pressure fluctuations within the common liquid chamber (the pressure waves which propagate from the pressure chambers). Also, the number of parts required can be reduced because the protective plate is provided with a thin-walled portion which also serves as a damper.

In the liquid ejecting apparatus of the present invention, the thin-walled portion of the protective plate may constructs a part of inner walls of the common liquid chamber. Therefore, the thin-walled portion of the protective plate can also function as a damper which absorbs pressure fluctuations within the common liquid chamber.

In the liquid ejecting apparatus of the present invention, the thin-walled portion may be formed continuously, over the plurality of pressure chambers. Since the thin-walled portion serving as the damper is formed over a plurality of pressure chambers, the surface area of the thin-walled portion is larger, and pressure fluctuations are absorbed better.

In the liquid ejecting apparatus of the present invention, the actuator may have a common electrode which sandwiches the piezoelectric layer between the common electrode and the plurality of individual electrodes on the side of the vibration plate opposite to the pressure chambers, this common electrode may extend continuously, over the plurality of individual electrodes, and a first channel formation hole which constructs a part of the first through-hole may be formed in this common electrode. Even when the common electrode thus extends continuously, over the plurality of individual electrodes, if the individual liquid channels penetrate the common electrode at the first channel formation hole, the common liquid chamber and the nozzles can be disposed on opposite sides with respect to the actuator.

In the liquid ejecting apparatus of the present invention, the piezoelectric layer may be provided over the plurality of pressure chambers, a second channel formation hole which constructs a part of the first through-hole may be formed in the piezoelectric layer, and a protective film which prevents liquid from permeating the piezoelectric layer may be formed on an inner surface of this second channel formation hole. Therefore, this protective film can prevent liquid from permeating the piezoelectric layer. In particular, when the liquid is electrically conductive, short-circuiting between the individual electrodes caused by this conductive liquid can be prevented.

In the liquid ejecting apparatus of the present invention, the piezoelectric layer may include piezoelectric portions which are provided individually corresponding to each of the plurality of pressure chambers, and the piezoelectric portions corresponding to each of the pressure chambers may be accommodated between the vibration plate and the protective plate while being isolated from the individual liquid channels. When the piezoelectric layer includes the piezoelectric portions thus provided individually corresponding to each of the plurality of pressure chambers, if the individual liquid channels penetrate the actuator but avoid the piezoelectric layer, then the formation of a through-hole in the piezoelectric layer can be omitted, which affords greater freedom in selecting the method for forming the piezoelectric layer. Also, since the piezoelectric portions of the piezoelectric layer are accommodated between the vibration plate and the protective plate while being isolated from the individual liquid channels, the liquid will not make contact with the piezoelectric layer, and there will be no permeation by the liquid.

In the liquid ejecting apparatus of the present invention, the nozzles may face downward, and the common liquid chamber may be disposed above the nozzles. In this case, it will be easier for any bubbles which have admixed in the liquid channels to be discharged to outside the common liquid chamber.

According to a second aspect of the present invention, there is provided a liquid ejecting apparatus, comprising a plurality of nozzles which eject liquid; a plurality of pressure chambers which communicate with the plurality of nozzles; a common liquid chamber which is common to the plurality of pressure chambers; and a piezoelectric layer which selectively varies a volume of the plurality of pressure chambers, wherein the common liquid chamber and the piezoelectric layer are disposed on a side opposite to the nozzles with respect to the pressure chambers.

In the liquid ejecting apparatus of the present invention, since the common liquid chamber and the piezoelectric layer are disposed on the side opposite to the nozzles in relation to the pressure chambers, there is greater freedom in designing the nozzle layout, and the nozzles can be disposed at higher density. As a result, the liquid ejecting apparatus can be more compact. Also, since the pressure chambers and the common liquid chamber can be designed independently, their volumes can be greater than with a conventional design. For instance, all of the plurality of pressure chambers can be present within a planar region in which the common liquid chamber is formed. This liquid ejecting apparatus may further comprise a vibration plate which covers the plurality of pressure chambers, wherein through holes may be formed in the vibration plate by which the pressure chambers and the nozzles are communicated. In this liquid ejecting apparatus, through holes may be formed in the piezoelectric layer by which the pressure chambers and the nozzles are communicated.

According to a third aspect of the present invention, there is provided a method for manufacturing a liquid ejecting apparatus, the liquid ejecting apparatus comprising a common liquid chamber; a plurality of pressure chambers disposed along a plane; a plurality of nozzles which eject liquid; a plurality of individual liquid channels which extend from the common liquid chamber through the pressure chambers to the nozzles; and an actuator which has a vibration plate disposed over the plurality of pressure chambers and a piezoelectric layer disposed on a side of the vibration plate opposite to the pressure chambers, and which selectively varies a volume of the plurality of pressure chambers, the method comprising: a hole formation step of forming, in the vibration plate, a channel formation hole which forms a part of the individual liquid channels; and a piezoelectric layer formation step of forming the piezoelectric layer in only a region of the vibration plate, where no channel formation hole is formed, by depositing particles of a piezoelectric material on a surface of the vibration plate on the side opposite to the pressure chambers, wherein the individual liquid channels are formed in the piezoelectric layer formation step to penetrate the actuator.

In this method for manufacturing a liquid ejecting apparatus, since particles of a piezoelectric material are deposited on the vibration plate after the channel formation hole has been formed in the vibration plate, the piezoelectric layer will be formed in only the region where no channel formation hole is formed. Accordingly, there is no need to separately perform a step of forming, in the piezoelectric layer, a hole which penetrates the individual liquid channels, and the manufacturing process can be simplified. It is advantageous to deposit the particles of the piezoelectric material by aerosol deposition method.

According to a fourth aspect of the present invention, there is provided an ink-jet printer which performs recording by ejecting ink onto a recording medium, comprising an ink-jet head which ejects ink onto the recording medium, wherein: the ink-jet head has a common ink chamber, a plurality of pressure chambers disposed along a plane, a plurality of nozzles which eject the ink, a plurality of individual ink channels which extend from the common ink chamber through the pressure chambers to the nozzles, and an actuator which is disposed so as to face the plurality of pressure chambers to selectively vary a volume of the plurality of pressure chambers; the common ink chamber is disposed on a side opposite to the nozzles with respect to the actuator, and as viewed in a direction perpendicular to the plane, the common ink chamber is disposed in a region which overlaps the pressure chambers, and the individual ink channels are formed to penetrate the actuator; and the nozzles face downward, and the common ink chamber is disposed above the nozzles.

BRIEF DESCRIPTION OF THE DRAWINGS

FIG. 20 shows steps of stacking a plurality of plates other than a nozzle plate 514, wherein

FIG. 21 shows steps of forming the nozzle plate, wherein

DESCRIPTION OF THE PREFERRED EMBODIMENTS

A first embodiment of the present invention will be described. This first embodiment is an example of applying the present invention to an ink-jet head which ejects ink from nozzles.

Figure 1:
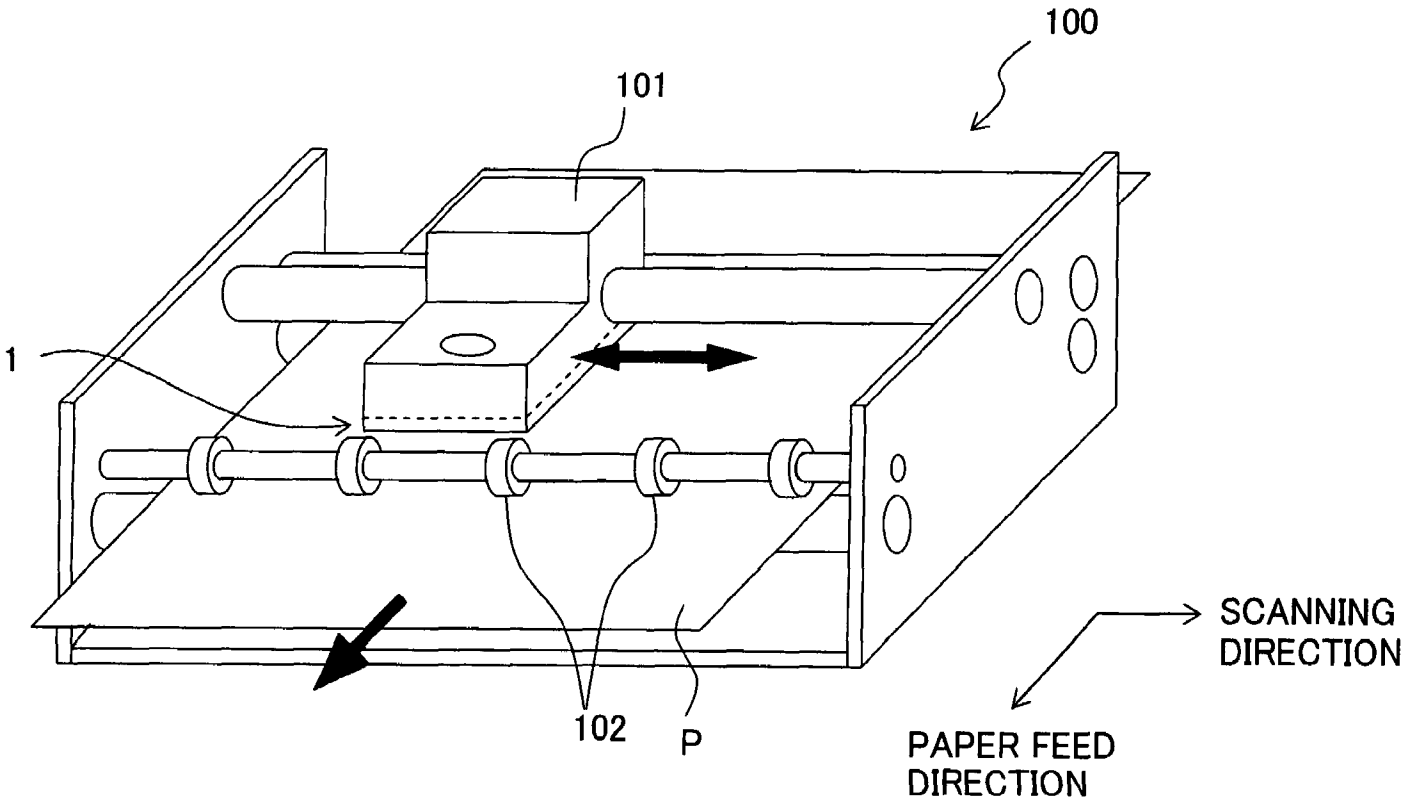
FIG. 1 is a schematic perspective view of an ink-jet printer pertaining to a first embodiment of the present invention.

First, an ink-jet printer 100 equipped with an ink-jet head 1 will be described. As shown in FIG. 1, the ink-jet printer 100 includes a carriage 101 capable of moving to the left and right in FIG. 1, an ink-jet head 1 of serial type which is provided on the carriage 101 and ejects ink onto recording paper P, conveyor rollers 102 for conveying the recording paper P in the forward direction in FIG. 1, and so forth. The ink-jet head 1 moves left and right (the scanning direction) integrally with the carriage 101, and ink is ejected from the outlets of nozzles (see FIGS. 2 to 6) formed on an ink ejection surface on the underside of this ink-jet head 1, onto the recording paper P. The recording paper P on which the ink-jet head 1 has recorded is then discharged forward (in the paper feed direction) by the conveyor rollers 102.

Next, the ink-jet head 1 will be described through reference to FIGS. 2 to 6. This ink-jet head 1 is made up of a plurality of stacked plates, and includes a plurality of individual ink channels 2 having a plurality of nozzles 20 which eject ink and a plurality of pressure chambers 16 which communicate with these nozzles 20 respectively, and a piezoelectric actuator 3 which selectively varies the volume of the pressure chambers 16.

Figure 3:
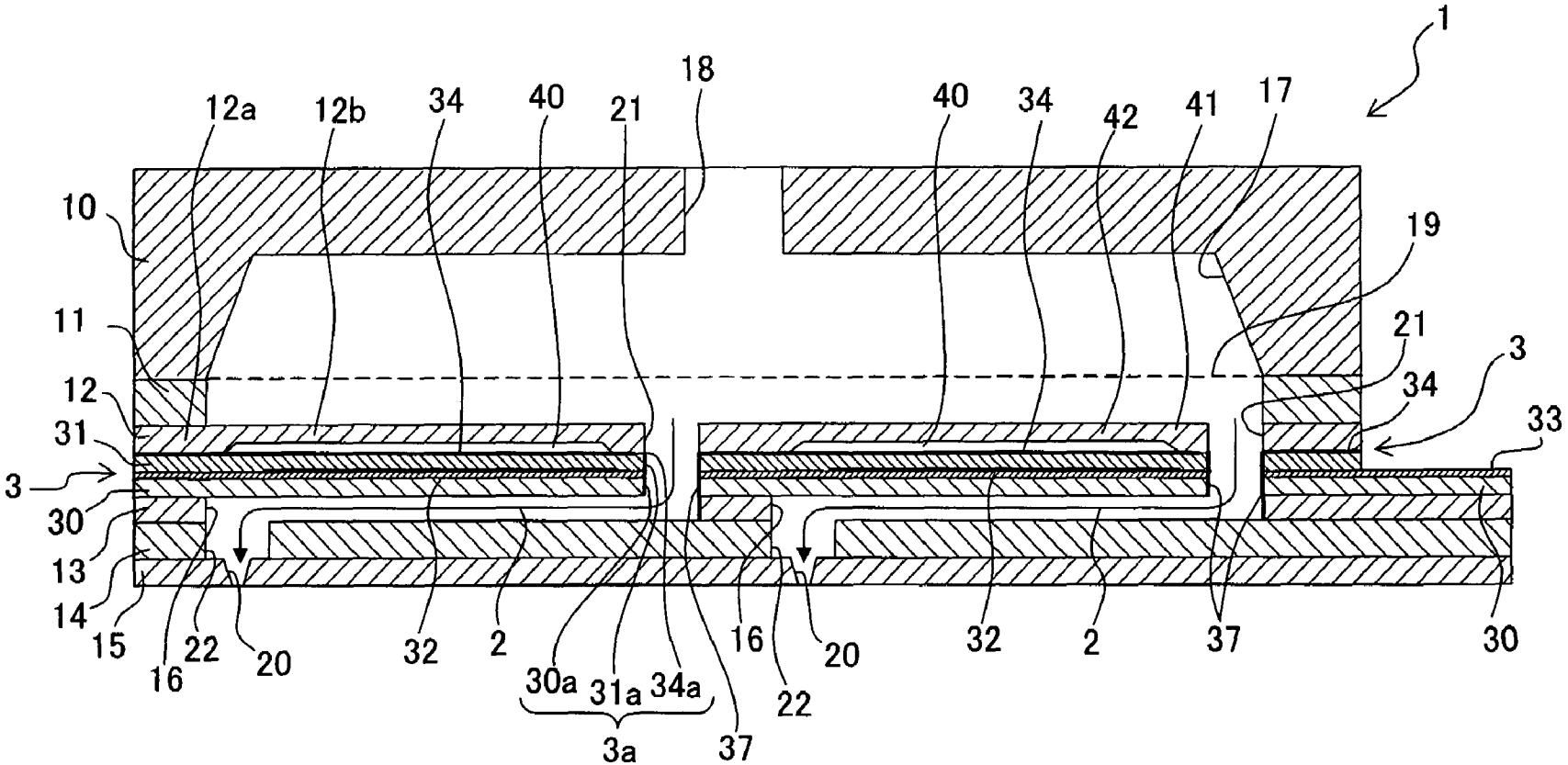
FIG. 3 is a cross section taken along the III-III line in FIG. 2.

As shown in FIG. 3, the individual ink channels 2 are formed by a plurality of plates including a vibration plate 30 and a piezoelectric layer 31 of the piezoelectric actuator 3. Starting from the top, these plates are stacked in the order of manifold plates 10 and 11, a protective plate 12, the piezoelectric actuator 3 (the vibration plate 30 and the piezoelectric layer 31), a pressure chamber plate 13, a descender plate 14, and a nozzle plate 15. Here, the manifold plates 10 and 11, the protective plate 12, the pressure chamber plate 13, and the descender plate 14 are made of a metal material such as stainless steel, and the ink channels in the manifold 17, pressure chambers 16, and so forth (discussed below) can be easily formed by etching. Meanwhile, the nozzle plate 15 is formed of a flexible synthetic resin material, such as a polyimide or other synthetic high-molecular resin material. Alternatively, the nozzle plate 15 may also be formed of a metal material just as are the other plates. If the nozzle plate 15 is formed of a metal material, it will have relatively high rigidity, so it may be possible to omit the descender plate 14 between the nozzle plate 15 and the pressure chamber plate 13, which is provided mainly for the purpose of providing sufficient rigidity.

Figure 2:
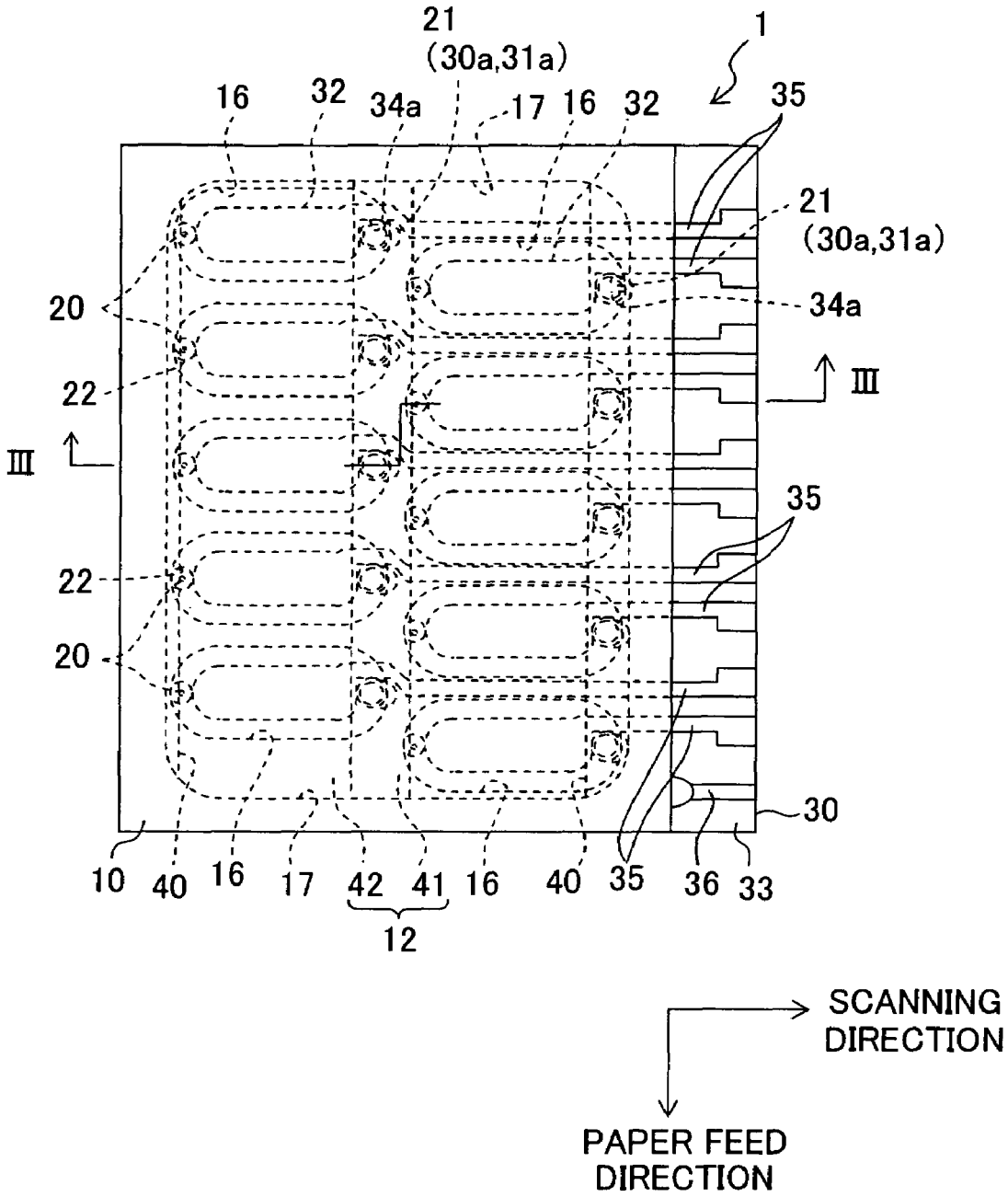
FIG. 2 is a plan view of an ink-jet head.

The manifold 17 (common liquid chamber, common ink chamber), which leads to the pressure chambers 16, is formed in the two manifold plates 10 and 11. As shown in FIGS. 2 and 3, this manifold 17 is formed in a region which overlaps all of the nozzles 20 and the pressure chambers 16 in plan view, and ink is supplied from an ink supply source (not shown) through an ink supply port 18 to the manifold 17. A filter 19 which removes any dust or the like which has admixed in the ink inside the manifold 17 is provided between the two manifold plates 10 and 11.

The protective plate 12 is provided so as to cover the piezoelectric actuator 3 from above, and protects the piezoelectric actuator 3. A through-hole 21 (second through-hole) which communicates with the manifold 17 is formed in this protective plate 12. Also, this protective plate 12 has a thick-walled portion 41 which is joined to the piezoelectric actuator 3, and a thin-walled portion 42 which is apart from the piezoelectric actuator 3. The thin-walled portion 42 is disposed to form a space 40 between the thin-walled portion and the portion of the piezoelectric actuator 3 which faces the pressure chambers 16, so that the protective plate 12 will not interfere with the deformation of the piezoelectric layer 31 of the piezoelectric actuator 3 (discussed below). Since the thin-walled portion 42 constructs a part of the bottom wall of the manifold 17, this thin-walled portion 42 also functions as a damper which absorbs pressure fluctuations within the manifold 17. Furthermore, this thin-walled portion 42 is formed continuously over the plurality of pressure chambers 16 arranged in the paper feed direction (there are five pressure chambers 16 arranged in a single vertical row in FIG. 2) in order to increase the surface area of the thin-walled portion 42 as much as possible and enhance the pressure fluctuation absorption effect when the thick-walled portion 41 serves as a damper.

The plurality of pressure chambers 16 arranged in a plane (in the same plane) as shown in FIG. 2 are formed in the pressure chamber plate 13. FIG. 2 only shows the top surface of the manifold plate 10, but the pressure chambers 16 are arranged on the surface of the pressure chamber plate 13, which is parallel to the top surface of the manifold plate 10. These pressure chambers 16 are disposed on the side (lower side) opposite to the side with the manifold 17 (upper side) with respect to the piezoelectric actuator 3. Further, these pressure chambers 16 are arranged in two rows in the paper feed direction (vertical direction in FIG. 2). These pressure chambers 16 are formed in a substantially elliptical shape in plan view, and are disposed such that their major axis direction is the scanning direction (to the left and right in FIG. 2). The piezoelectric actuator 3, which extends along this pressure chamber plate 13, is provided on the top surface of the pressure chamber plate 13 so as to cover the pressure chambers 16. Each of the pressure chambers 16 communicates with the manifold 17 via the through-hole 21 formed in the protective plate 12, and a through-hole 3*a* (first through-hole) formed in the piezoelectric actuator 3.

A plurality of communicating holes 22 are formed in the descender plate 14 at locations which overlap the left ends of the pressure chambers 16 in FIG. 2 (in a plan view). A plurality of nozzles 20 which face downward are formed in the nozzle plate 15 at locations which overlap the left end of the pressure chambers 16 in FIG. 2 (in a plan view).

Figure 4:
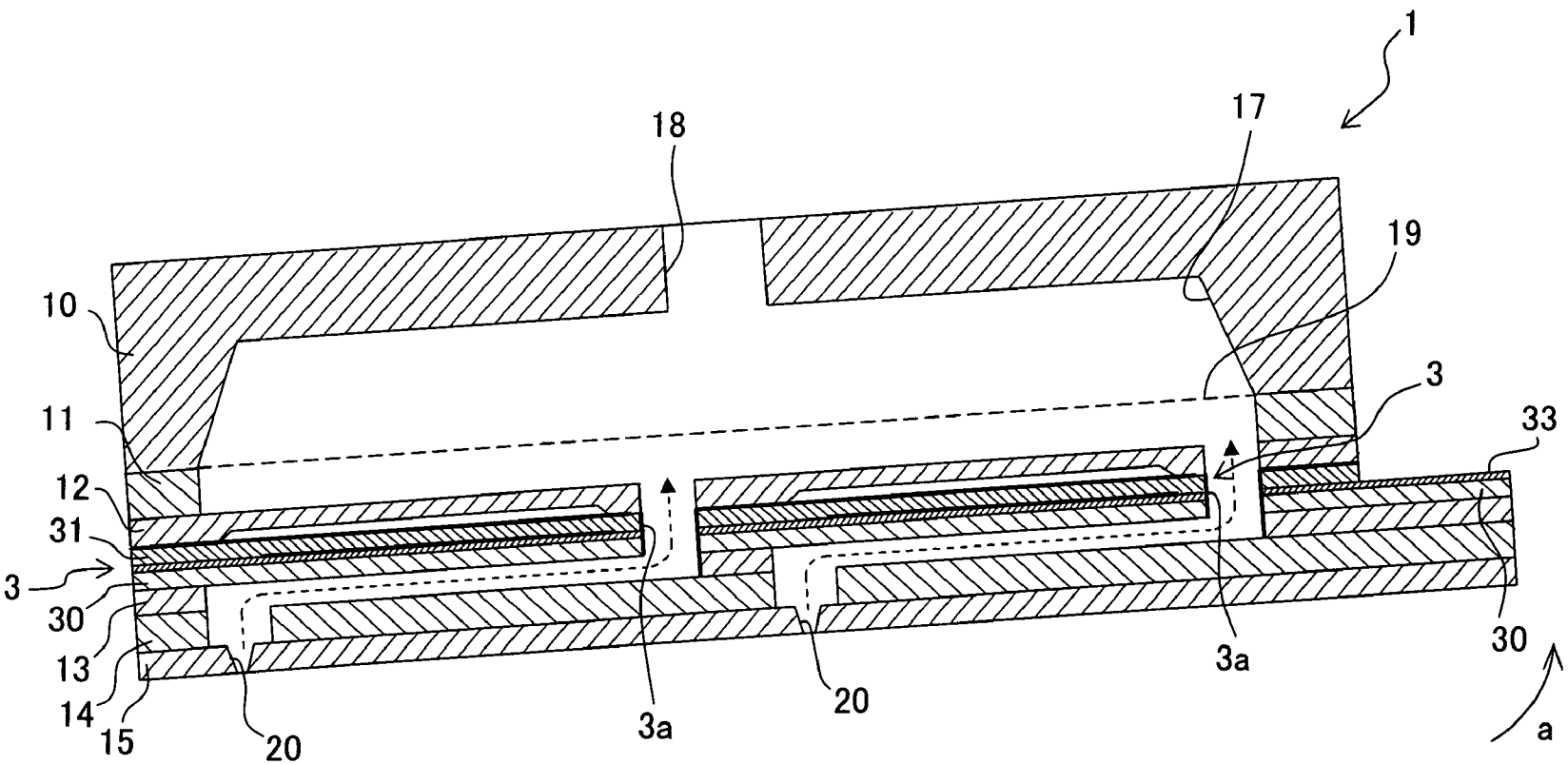
FIG. 4 is a cross section of an ink-jet head which is disposed tilted, corresponding to FIG. 3.

As shown in FIGS. 3 and 4, a plurality of individual ink channels 2 are formed in the ink-jet head 1, from the manifold 17, through the piezoelectric actuator 3 at starting the through-hole 3*a*, then penetrating through the pressure chambers 16, and reaching to the nozzles 20. Since the manifold 17 is thus disposed on the side opposite to the nozzles 20 with respect to the piezoelectric actuator 3, the nozzles 20 can be disposed over a larger region, and the nozzles 20 can be disposed at higher density. Also, since the manifold 17 is disposed in a region which overlaps the nozzles 20 and the pressure chambers 16 in plan view (in particular, in this embodiment, as shown in FIG. 2, all of the pressure chambers are within the region (in plan view) in which the common liquid chamber is formed), a large surface area (the surface area projected from above) can be ensured for the manifold 17, and the volume of the manifold 17 can be increased. Alternatively, the same volume can be maintained while the height of the manifold 17 is lowered by an amount corresponding to the increase in surface area, so the manifold plates 10 and 11 can be made thinner, which affords a more compact ink-jet head 1.

Also, since the nozzles 20 face vertically downward, and are disposed lower than the manifold 17 in the vertical direction, any bubbles which admixed into the individual ink channels 2 will readily move to the manifold 17 under their own buoyancy, making it easy to discharge the bubbles to the manifold 17 side. Furthermore, as shown in FIG. 4, the ink-jet head 1 may be tilted from the state in FIG. 3 at an angle of less than 90 degrees in the direction of the arrow a, and the nozzles 20 may face downward obliquely, in which case any bubbles inside the individual ink channels 2 will more readily move to the manifold 17 as indicated by the broken-line arrows. Thus, when the manifold 17 is disposed higher than the nozzles 20 in the vertical direction, any bubbles admixed in the individual ink channels 2 will move to the manifold 17 more readily under their own buoyancy, but in particular, as shown in FIG. 4, bubbles admixed in the individual ink channels 2 can be more effectively moved to the manifold 17 if the individual ink channels 2 are formed so as to extend upward in the vertical direction toward the upstream side of the ink flow.

The piezoelectric actuator 3 will now be described.

The piezoelectric actuator 3 includes the vibration plate 30 which covers the upper side of the plurality of pressure chambers 16, an insulating layer 33 formed on the top surface of the vibration plate 30 (the opposite side from the pressure chambers 16), a plurality of individual electrodes 32 formed corresponding to each of the plurality of pressure chambers 16 on this insulating layer 33, the piezoelectric layer 31 formed on the top surface of the insulating layer 33, and the common electrode 34 formed in common over the plurality of individual electrodes 32 on the top surface of this piezoelectric layer 31.

The vibration plate 30 is a plate formed of a metal material and is substantially rectangular in plan view. For example, the vibration plate can be formed of an iron alloy such as stainless steel, a copper alloy, a nickel alloy, a titanium alloy, or the like. This vibration plate 30 is joined to the top surface of the pressure chamber plate 13 so as to close the plurality of pressure chambers 16. The insulating layer 33, which is formed of a ceramic material with a high modulus of elasticity, such as silicon nitride, zirconia, or alumina, is formed on the surface of this vibration plate 30. Because the insulating layer 33 is formed of a ceramic material with a high modulus of elasticity, the piezoelectric actuator 3 has greater rigidity and its responsiveness is higher. A through-hole 30*a* which forms a part of the individual ink channels 2 is formed in this vibration plate 30 (and the insulating layer 33).

A plurality of individual electrodes 32 which are elliptical in plan view and are smaller in size than the pressure chambers 16 to a certain extent are formed on the top surface of the insulating layer 33. The individual electrodes 32 are formed at locations which overlap the centers of the corresponding pressure chambers 16 in plan view. The individual electrodes 32 are made of gold or another such electrically conductive material, and the adjacent individual electrodes 32 are electrically insulated from one another by the insulating layer 33. A plurality of wires 35 which are parallel to the longitudinal direction of the individual electrodes 32 (the scanning direction) extend from one end of the plurality of individual electrodes 32 in the longitudinal direction (the right end in FIG. 2), and these wires 35 are connected to a driver IC (not shown) which selectively supplies drive voltage to the individual electrodes 32.

The piezoelectric layer 31, whose main component is lead zirconate titanate (PZT), which is a ferroelectric substance and is a solid solution of lead titanate and lead zirconate, is formed on the top surface of the insulating layer 33, continuously over the plurality of individual electrodes 32. Also, a common electrode 34 which is common to the individual electrodes 32 is formed over the entire surface of the piezoelectric layer 31 on the top surface thereof. A through-hole 31*a* (second channel formation hole) and a through-hole 34*a* (first channel formation hole) which form a part of each of the individual ink channels 2 are formed in the piezoelectric layer 31 and the common electrode 34, respectively. The through-hole 30*a* of the vibration plate 30, the through-hole 31*a* of the piezoelectric layer 31, and the through-hole 34*a* of the common electrode 34 constructs a through-hole 3*a* (first through-hole) which penetrates through the piezoelectric actuator 3. The through-hole 3*a* forms a part of the individual ink channel 2*a*. Also, as shown in FIG. 2, a single wire 36 connected to the driver IV extends from the common electrode 34, and the common electrode 34 is maintained at ground potential through the wire 36 and the driver IC.

When the piezoelectric layer 31 is exposed through the through-hole 31*a* to the individual ink channels 2, there is the danger that the ink, which is conductive, will permeate the piezoelectric layer 31, and that the individual electrodes 32 will be short-circuited by this ink. In view of this, in the ink-jet head of this embodiment, a protective film 37 is formed on the inner surface of the through-hole 3*a* to prevent the ink flowing through the individual ink channels 2 from permeating the piezoelectric layer 31. This protective film 37 is formed of silicon oxide or silicon nitride, for example.

Next, the operation of the piezoelectric actuator 3 during ink ejection will be explained.

When drive voltage is selectively supplied from the driver IC through the wires 35 to the individual electrodes 32, the individual electrodes 32 on the lower side of the piezoelectric layer 31 to which the drive voltage is supplied are in a different potential state from that of the common electrode 34 on the upper side of the piezoelectric layer 31 maintained at ground potential, creating a vertical electrical field in the piezoelectric layer 31 sandwiched between the electrodes 32 and 34. At this point, the portion of the piezoelectric layer 31 which is sandwiched between the common electrode 34 and the individual electrodes 32 to which the drive voltage has been applied contracts horizontally (perpendicular to the vertical direction, which is the direction of polarization). Since the vibration plate 30 on the lower side of the piezoelectric layer 31 is fixed with respect to the pressure chamber plate 13, the portion of the piezoelectric layer 31 sandwiched between the electrodes 32 and 34 deforms so as to project toward the pressure chambers 16, and this partial deformation of the piezoelectric layer 31 is accompanied by deformation of the portion of the vibration plate 30 covering the pressure chambers 16, also to project toward the pressure chambers 16. At this point there is a reduction in the volume inside the pressure chambers 16, and pressure is applied to the ink, so the ink is ejected from the nozzles 20 communicating with the pressure chambers 16.

When pressure has been applied to the ink in a certain pressure chamber 16 by the piezoelectric actuator 3, a phenomenon (so-called fluid crosstalk) may occur, whereby the pressure waves propagate through the manifold 17 to another pressure chamber 16, and this can result in variance in the ejection characteristics from the nozzles 20. In this first embodiment, however, as discussed above, the manifold 17 is disposed in a region which overlaps the pressure chambers 16 and the nozzles 20 (see FIGS. 2 to 5), so the surface area of the manifold 17 can be increased and its volume raised, which effectively attenuates pressure fluctuations within the manifold 17 (including pressure waves which propagate from the pressure chambers 16 to the manifold 17), allowing crosstalk to be suppressed.

Also, since the piezoelectric actuator 3 is protected by the protective plate 12, the ink inside the manifold 17 does not directly contact the piezoelectric actuator 3. Further, the protective film 37 is formed on the inner surface of the through-hole 31*a* formed in the piezoelectric layer 31, to prevent the ink flowing through the individual ink channels 2 from permeating the piezoelectric layer 31. Accordingly, the conductive ink does not permeate the piezoelectric layer 31, and this prevents short-circuiting between the individual electrodes 32.

Since the thin-walled portion 42 of the protective plate 12 is disposed to form a space 40 between the thin-walled portion 42 and the portion of the piezoelectric actuator 3 which faces the pressure chambers 16, the protective plate 12 will not interfere with the deformation of the piezoelectric layer 31 when drive voltage is applied to the individual electrodes 32 and the portion of the piezoelectric layer 31 corresponding to these individual electrodes 32 deforms, and this prevents a decrease in the drive efficiency of the piezoelectric actuator 3. Also, since this thin-walled portion 42 constructs a part of the bottom wall of the manifold 17, and also functions as a damper which absorbs pressure fluctuations of the ink within the manifold 17, the propagation of pressure waves from the pressure chambers 16 to the manifold 17 can be more effectively attenuated, and crosstalk can be effectively suppressed. Further, since the thin-walled portion 42 is formed continuously over the plurality of pressure chambers arranged in the paper feed direction (the five pressure chambers arranged in a vertical row in FIG. 2), the thin-walled portion 42 has a larger surface area, and the pressure fluctuation absorption effect of the damper is further enhanced.

Figure 5:
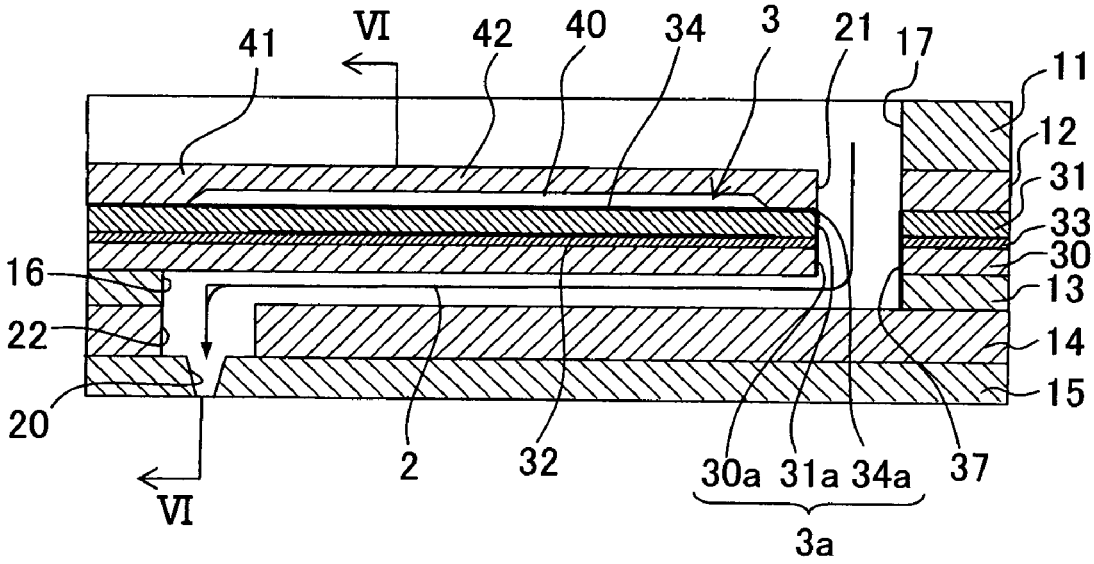
FIG. 5 is a partially enlarged view of FIG. 4.
Figure 6:
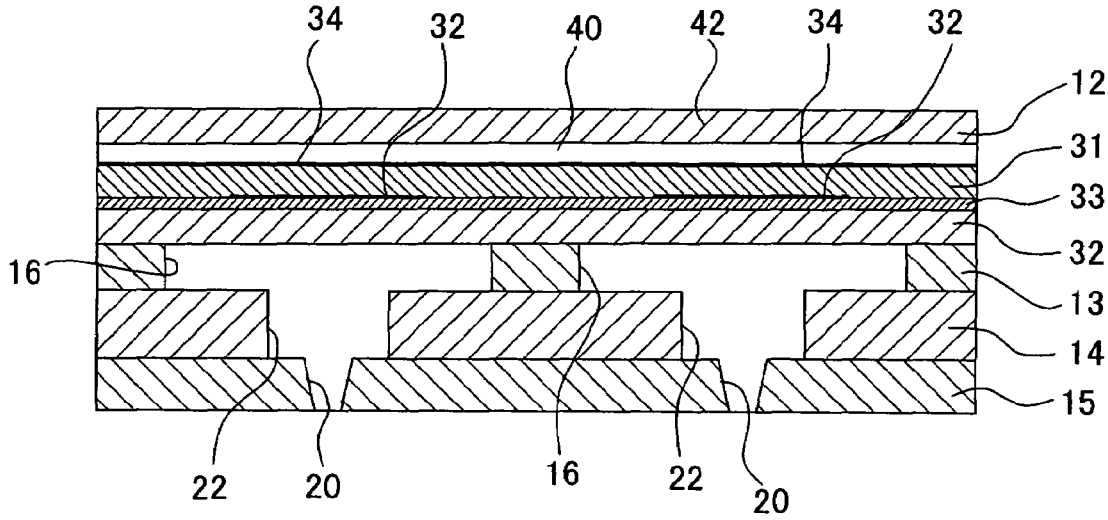
FIG. 6 is a cross section taken along the VI-VI line in FIG. 5.

Also, as shown in FIGS. 3 to 5, the manifold 17 is disposed on the side opposite to the pressure chambers 16 with respect to the piezoelectric actuator 3, and the pressure chambers 16 and the nozzles 20 are disposed on the same side, so the distance from the pressure chambers 16 to the nozzles 20 is shorter, thereby reducing the drive voltage applied to the individual electrodes 32 in order to vary the volume of the pressure chambers by deforming the piezoelectric layer 31 and the vibration plate 30. Accordingly, the drive efficiency of the piezoelectric actuator 3 is increased. Furthermore, when the nozzle plate 15 is made from a metal material, this nozzle plate 15 will have relatively high rigidity, so it will be possible to omit the descender plate 14 between the nozzle plate 15 and the pressure chamber plate 13, and therefore the distance from the pressure chambers 16 to the nozzles 20 will be even shorter and the drive efficiency of the piezoelectric actuator 3 can be further improved.

The method for manufacturing the ink-jet head 1 will now be described through reference to FIGS. 7 and 8.

Figure 7A:
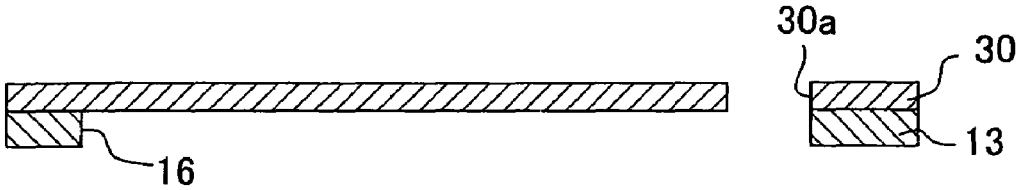
FIG. 7 is a diagram of the step of forming a piezoelectric actuator in a pressure chamber plate, which is one of the steps of manufacturing an ink-jet head, with FIG. 7A being a step of joining the pressure chamber plate and the vibration plate, FIG. 7B being an insulating layer formation step, FIG. 7C being an individual electrode formation step, FIG. 7D being a piezoelectric layer formation step, and FIG. 7E being a common electrode formation step.

As shown in FIG. 7A, first, the through-hole 30*a* which forms a part of the individual ink channels 2 is formed in the vibration plate 30 by etching or the like (hole formation step), and the vibration plate 30 and the pressure chamber plate 13 in which the pressure chambers 16 are formed are joined by metal diffusion, or with an adhesive, or by some other such method.

Figure 7B:
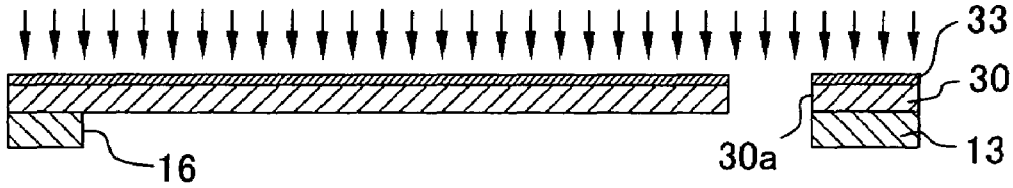
Figure 7C:
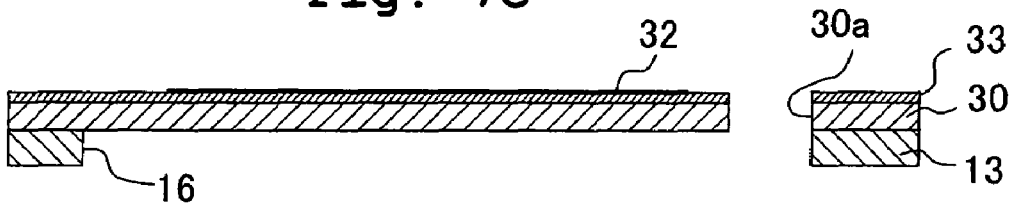

Next, as shown in FIG. 7B, the insulating layer 33 is formed by depositing particles of a ceramic material on the side of the vibration plate 30 opposite to the pressure chambers 16. The method for depositing the ceramic material on the vibration plate 30 here may be, for example, aerosol deposition (AD) method in which ultrafine particles are deposited by being made to collide at high speed. In addition, sputtering method or CVD (chemical vapor deposition) method may also be used. As shown in FIG. 7C, the individual electrodes 32 are formed by screen printing, vapor deposition, or another such method in the region of the surface of this insulating layer 33 which faces the pressure chambers 16.

Figure 7D:
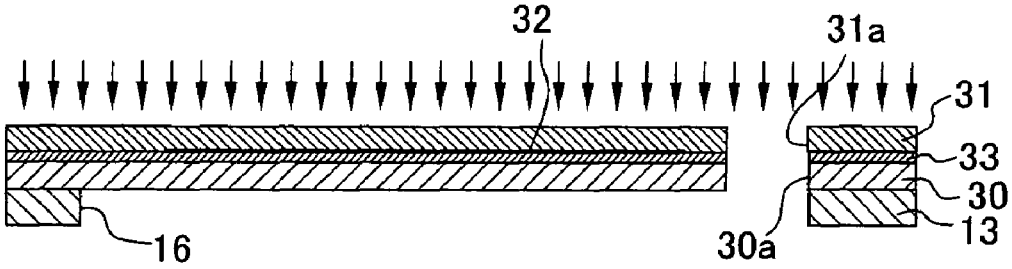

Then, as shown in FIG. 7D, particles of piezoelectric elements are deposited and a heat treatment is performed on the surface of the insulating layer 33 which is on the side opposite to the pressure chamber plate 13, thereby forming the piezoelectric layer 31 in only the region where no through-hole 30*a* of the vibration plate 30 has been formed (piezoelectric layer formation step). The method for depositing the piezoelectric elements on the vibration plate 30 here may be AD method, sputtering method, or CVD method. When the particles of piezoelectric elements are deposited on the vibration plate 30 to form the piezoelectric layer 31, the through-hole 31*a* which forms a part each of the individual ink channels 2 along with the through-hole 30*a* is simultaneously formed at a location in the piezoelectric layer 31 corresponding to the through-hole 30*a* of the vibration plate 30. Therefore, there is no need to separately perform the step of forming the through-hole 31*a* in the piezoelectric layer 31, and the manufacturing process can be simplified.

Figure 7E:
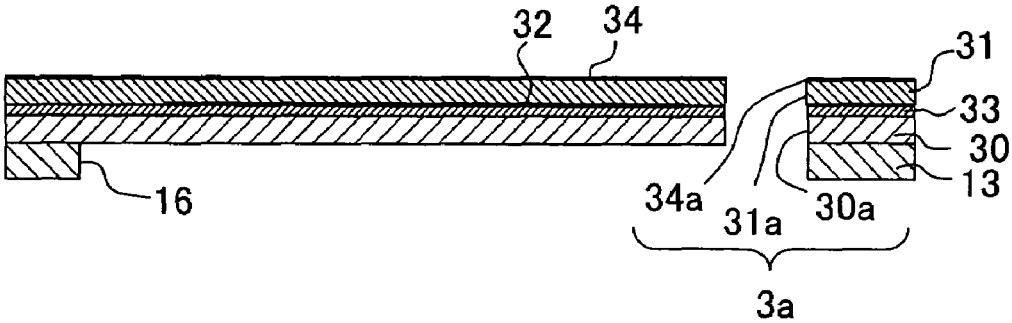

As shown in FIG. 7E, the common electrode 34 having the through-hole 34*a* is formed continuously over the plurality of individual electrodes 32 on the surface of the piezoelectric layer 31 by screen printing, vapor deposition, or the like.

Figure 8A:
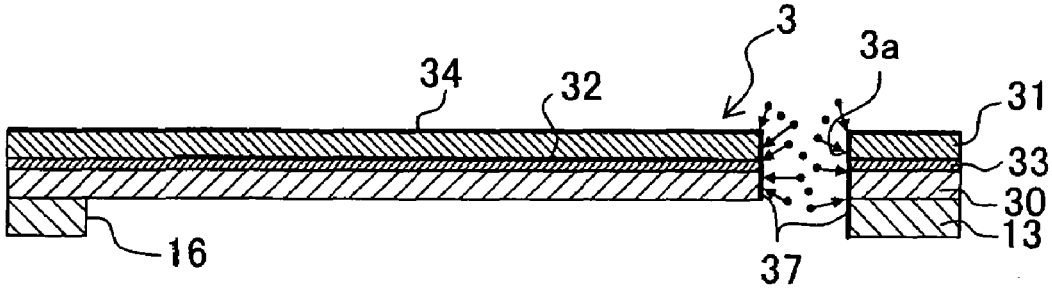
FIG. 8 is a diagram of the steps of manufacturing an ink-jet head following the formation of a piezoelectric actuator, with FIG. 8A being a protective film formation step, FIG. 8B being a step of joining a descender plate and nozzle plate, and FIG. 8C being a step of joining a protective plate and a manifold plate.
Figure 8B:
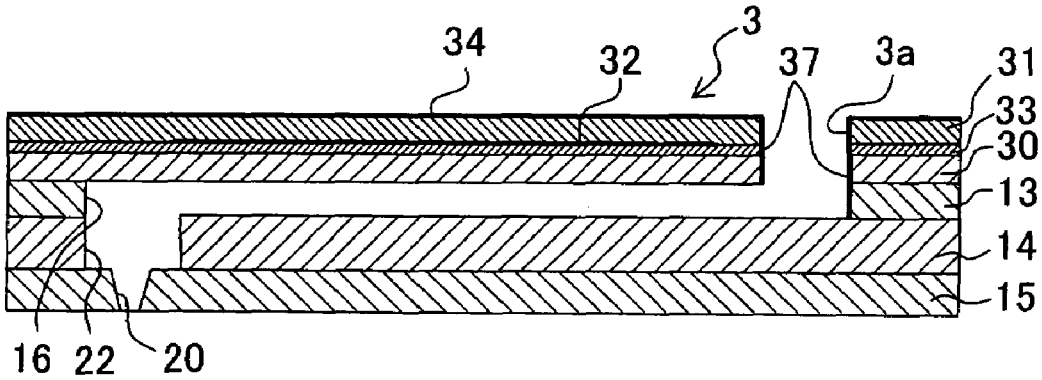
Figure 8C:
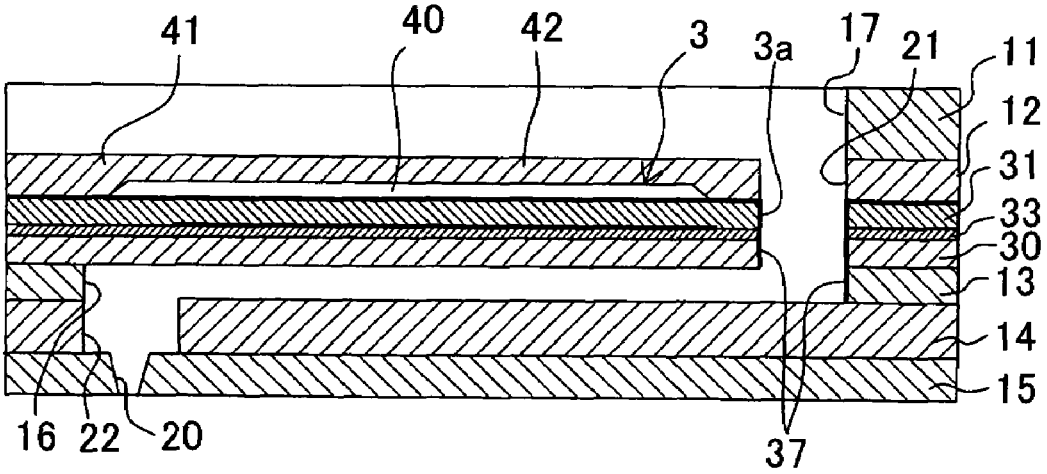

Next, as shown in FIG. 8A, the protective film 37, which prevents ink from permeating the piezoelectric layer 31, is formed by AD method, sputtering method, CVD method, or the like on the inner surface of the through-hole 3*a* of the piezoelectric actuator 3 (the through-hole 30*a* of the vibration plate 30, the through-hole 31*a* of the piezoelectric layer 31, and the through-hole 34*a* of the common electrode 34). As shown in FIG. 8B, the descender plate 14 and the nozzle plate 15 are joined with an adhesive or the like on the bottom surface of the pressure chamber plate 13. Then, as shown in FIG. 8C, the protective plate 12 is joined with an adhesive or the like to the surface of the common electrode 34 of the piezoelectric actuator 3 so that the space 40 is interposed between the thin-walled portion 42 of the protective plate 12 and the portion of the piezoelectric actuator 3 which faces the pressure chambers 16, and the manifold plates 10 and 11 are joined to this protective plate 12, which completes the manufacture of the ink-jet head 1.

The following effects are obtained with the ink-jet head 1 and its manufacturing method described above.

Since the individual ink channels 2 penetrate the piezoelectric actuator 3 at the through-hole 3*a*, and the manifold 17 is disposed on the side opposite to the nozzles 20 with respect to the piezoelectric actuator 3, compared to when the nozzles 20 and the manifold 17 are disposed on the same side, the region in which the nozzles 20 can be disposed can be kept larger, and the nozzles 20 can be disposed at higher density. Also, since the manifold 17 is disposed in a region which overlaps the nozzles 20 and the pressure chambers 16 in plan view, the surface area of the 17 can be increased and its volume raised. Therefore, it is possible to suppress crosstalk by effectively attenuating the pressure waves which propagate from the pressure chambers 16 to the manifold 17. Alternatively, since the surface area of the manifold 17 is larger, the same volume can be maintained while the height of the manifold 17 is lowered by an amount corresponding to the increase in surface area, so the manifold plates 10 and 11 can be made thinner, which affords a more compact ink-jet head 1.

Since the piezoelectric actuator 3 is protected by the protective plate 12, the ink inside the manifold 17 does not directly contact the piezoelectric actuator 3, and short-circuiting between the individual electrodes 32 caused by the conductive ink can be kept to an absolute minimum. Also, since the thin-walled portion 42 of the protective plate 12 is disposed to form the space 40 between the thin-walled portion 42 and the portion of the piezoelectric actuator 3 which faces the pressure chambers 16, the protective plate 12 will not interfere with the deformation of the piezoelectric layer 31 when drive voltage is applied to the individual electrodes 32 and the portion of the piezoelectric layer 31 corresponding to these individual electrodes 32 deforms. Furthermore, since the thin-walled portion 42 constructs a part of the bottom wall of the manifold 17, this thin-walled portion 42 also functions as a damper which absorbs pressure fluctuations within the manifold 17, so the propagation of pressure waves from the pressure chambers 16 to the manifold 17 can be more effectively attenuated, and crosstalk can be effectively suppressed.

Next, modifications, in which various changes are made to the first embodiment given above, will be explained. Those components which have the same constitution as in the first embodiment are assigned with the same reference numerals and their explanation is omitted as appropriate.

First Modified Embodiment

Figure 9:
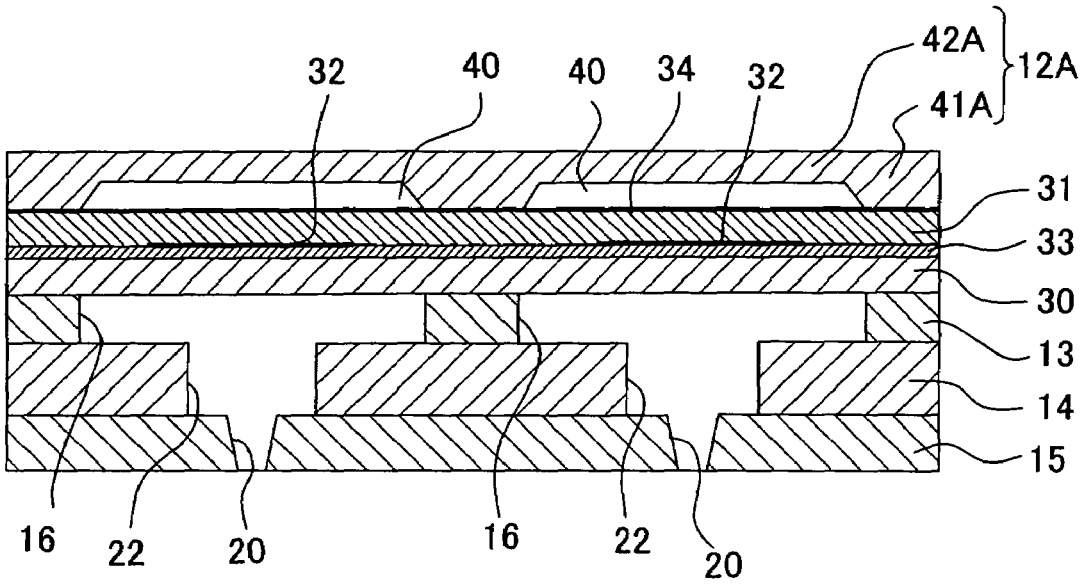
FIG. 9 is a cross section of a first modified embodiment, corresponding to FIG. 6.

As shown in FIG. 9, a protective plate 12A may have a thick-walled portion 41A and a thin-walled portion 42A, and the thin-walled portion 42A (damper) may be formed individually for each of the plurality of pressure chambers 16.

Second Modified Embodiment

Figure 10:
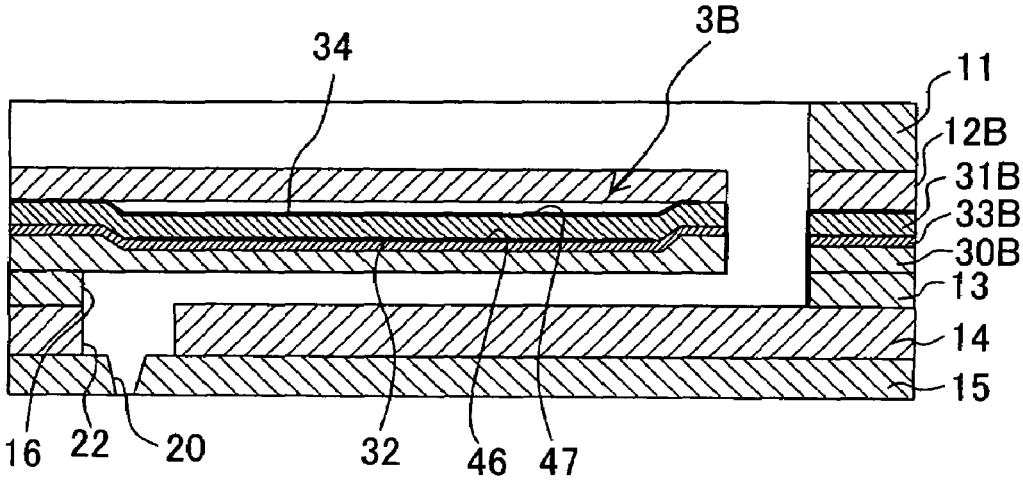
FIG. 10 is a cross section of a second modified embodiment, corresponding to FIG. 5.

In the first embodiment, the thin-walled portion 42 of the protective plate 12 was formed in order to keep the protective plate 12 from interfering with the deformation of the piezoelectric layer 31, but a recess may be formed on a side of a piezoelectric actuator 3B, and a gap may be formed between a protective plate 12B and the piezoelectric actuator 3B. For example, as shown in FIG. 10, a recess 46 may be formed in a vibration plate 30B (and insulating layer 33B) of the piezoelectric actuator 3B, and a recess 47 corresponding to a recess 30*a* of the vibration plate 30B may be formed in a piezoelectric layer 31B. In this case, the recess 47 of the piezoelectric layer 31B can be simultaneously formed by forming the piezoelectric layer 31B in a uniform thickness by AD, CVD, or another such method on the side of the vibration plate 30B (insulating layer 33B) on which the recess 46 is formed.

Third Modified Embodiment

Figure 11:
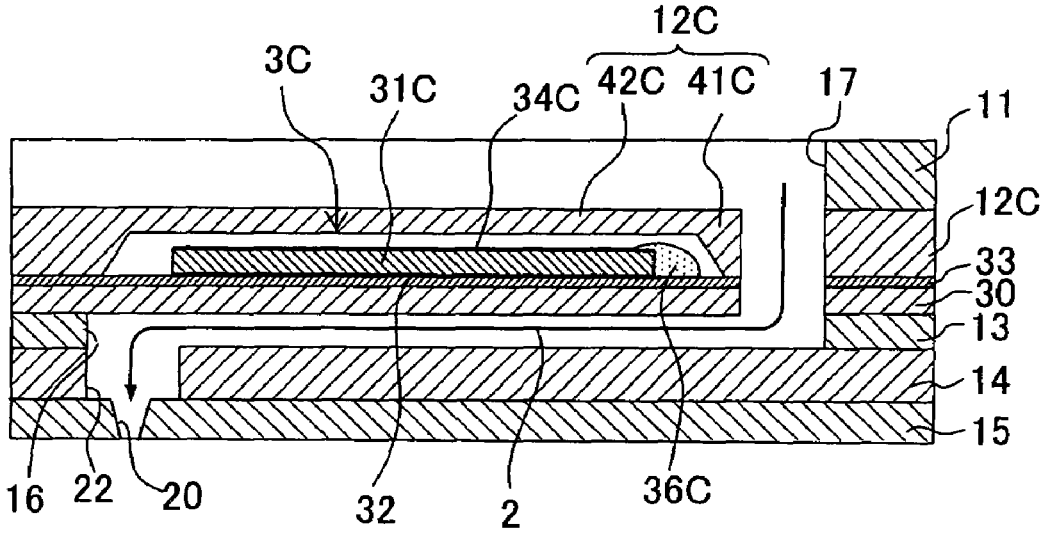
FIG. 11 is a cross section of a third modified embodiment, corresponding to FIG. 5.
Figure 12:
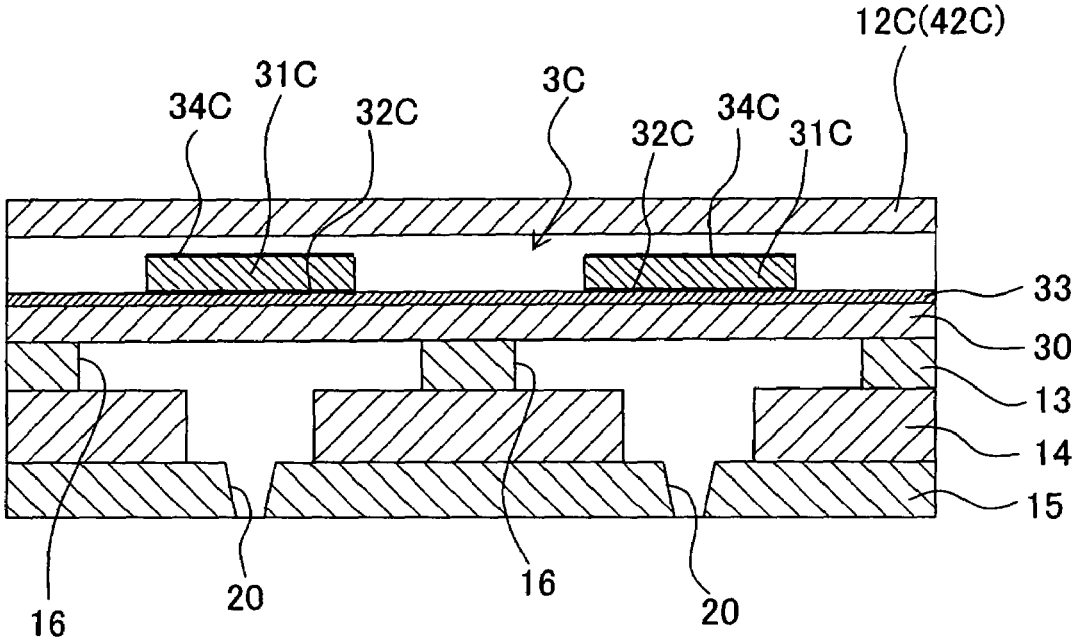
FIG. 12 is a cross section of the third modified embodiment, corresponding to FIG. 6.

As shown in FIGS. 11 and 12, piezoelectric layers 31C may be formed individually corresponding to each of a plurality of pressure chambers 16, and the piezoelectric layers 31C corresponding to the pressure chambers 16 may be kept isolated from the individual ink channels 2 within the space formed between the vibration plate 30 and a protective plate 12C having a thick-walled portion 41C and a thin-walled portion 42C. Further, with this third modification, a common electrode 34C is formed on the top surface of the plurality of piezoelectric layers 31C corresponding to the plurality of pressure chambers 16, and the common electrode 34C is maintained at ground potential through a wire 36C formed on the top surface of the insulating layer 33.

When the piezoelectric layer 31C is thus provided individually to each of the plurality of pressure chambers 16, if the individual liquid channels 2 penetrate the actuator 3C but avoid the piezoelectric layer 31, then the formation of a through-hole in the piezoelectric layer 31C can be omitted. This affords greater freedom in selecting the method for forming the piezoelectric layer. Another piezoelectric layer formation method can be employed, for example, such as a method in which a piezoelectric sheet formed by baking a PZT green sheet is stuck onto the surface of the vibration plate 30 (insulating layer 33). Also, since the piezoelectric layer 31C is accommodated between the vibration plate 30 and the protective plate 12C, the liquid will not contact the piezoelectric layer 31C, and there will be no permeation by the ink.

Fourth Modified Embodiment

Figure 13:
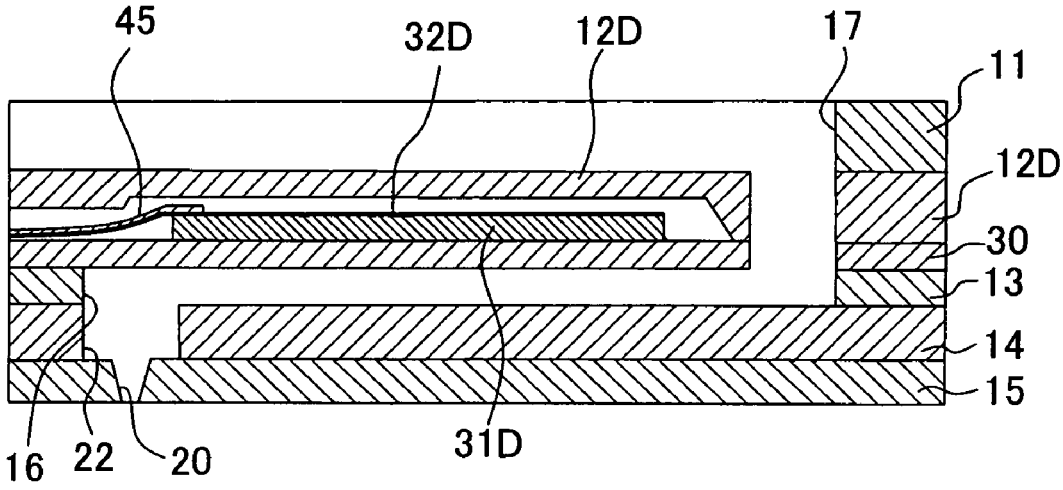
FIG. 13 is a cross section of a fourth modified embodiment 4, corresponding to FIG. 5.

The layout of the individual electrodes and the common electrode is not limited to the layout in the first embodiment. For instance, as shown in FIG. 13, the metal vibration plate 30 may also serve as the common electrode, a piezoelectric layer 31D formed on the top surface of the vibration plate 30 may be disposed within a space between a protective plate 12D and the vibration plate 30, and individual electrodes 32D may be formed on the top surface of this piezoelectric layer 31D. In this case, a wiring member 45 such as a flexible printed circuit (FPC) or the like can be used to electrically connect the individual electrodes 32D to a driver IC (not shown) which supplies drive voltage to the individual electrodes 32D. In this modified embodiment, the actuator includes the piezoelectric layer 31D and the vibration plate 30, but a through-hole is formed in only the vibration plate 30. Thus, an actuator in which a through-hole which forms individual liquid channels is formed in only a part of the actuator (the vibration plate) is also intended to be encompassed by the actuator which "has a first through-hole which forms individual liquid channels" referred to in the present invention.

A second embodiment of the present invention will be explained.

An explanation will be made with reference to FIGS. 14 to 19 about an ink-jet head 501 which can be used in the ink-jet printer shown in FIG. 1. The ink-jet head 501 is constructed by a plurality of stacked plates. The ink-jet head 501 includes a plurality of individual ink flow passages 502 including a plurality of nozzles 520 which jet the ink and a plurality of pressure chambers 516 which are communicated with the plurality of nozzles 520 respectively, and a piezoelectric actuator 503 which selectively changes the volumes of the plurality of pressure chambers 516.

Figure 15:
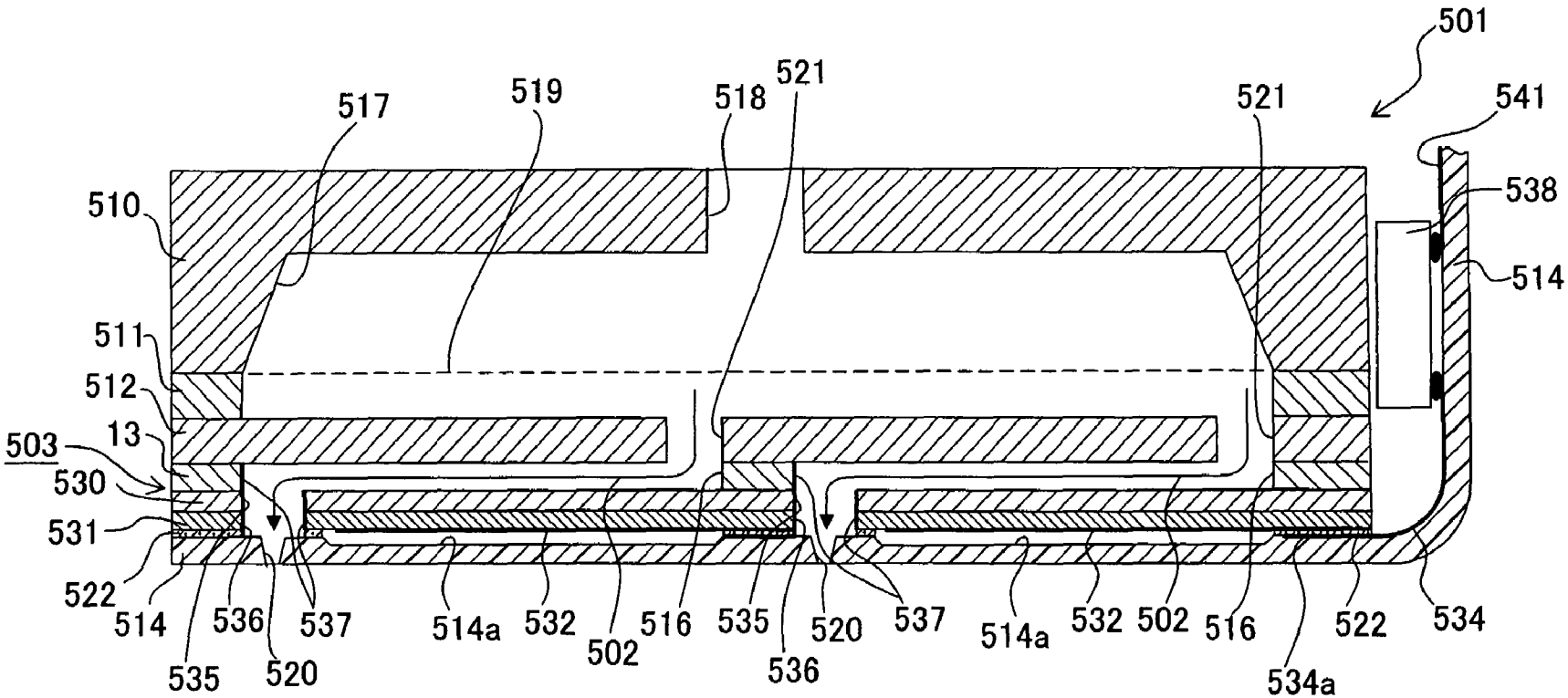
FIG. 15 shows a sectional view taken along a line XV-XV shown in FIG. 14.

As shown in FIG. 15, the plurality of individual ink flow passages 502 are formed by a plurality of plates including a piezoelectric layer 531 and a vibration plate 530 of the piezoelectric actuator 503. The plurality of plates are stacked from the upper position in an order of manifold plates 510, 511, a base plate 512, a pressure chamber plate 513, the vibration plate 530 and the piezoelectric layer 531 of the piezoelectric actuator 503, and a nozzle plate 514. Each of the manifold plates 510, 511, the base plate 512, and the pressure chamber plate 513 is a metal plate composed of stainless steel or the like. The ink flow passages, which include, for example, a manifold 517 and pressure chambers 516 as described later on, can be formed with ease by means of the etching. On the other hand, the nozzle plate 514 is formed of a flexible synthetic resin material, for example, a high polymer synthetic resin material such as polyimide.

Figure 14:
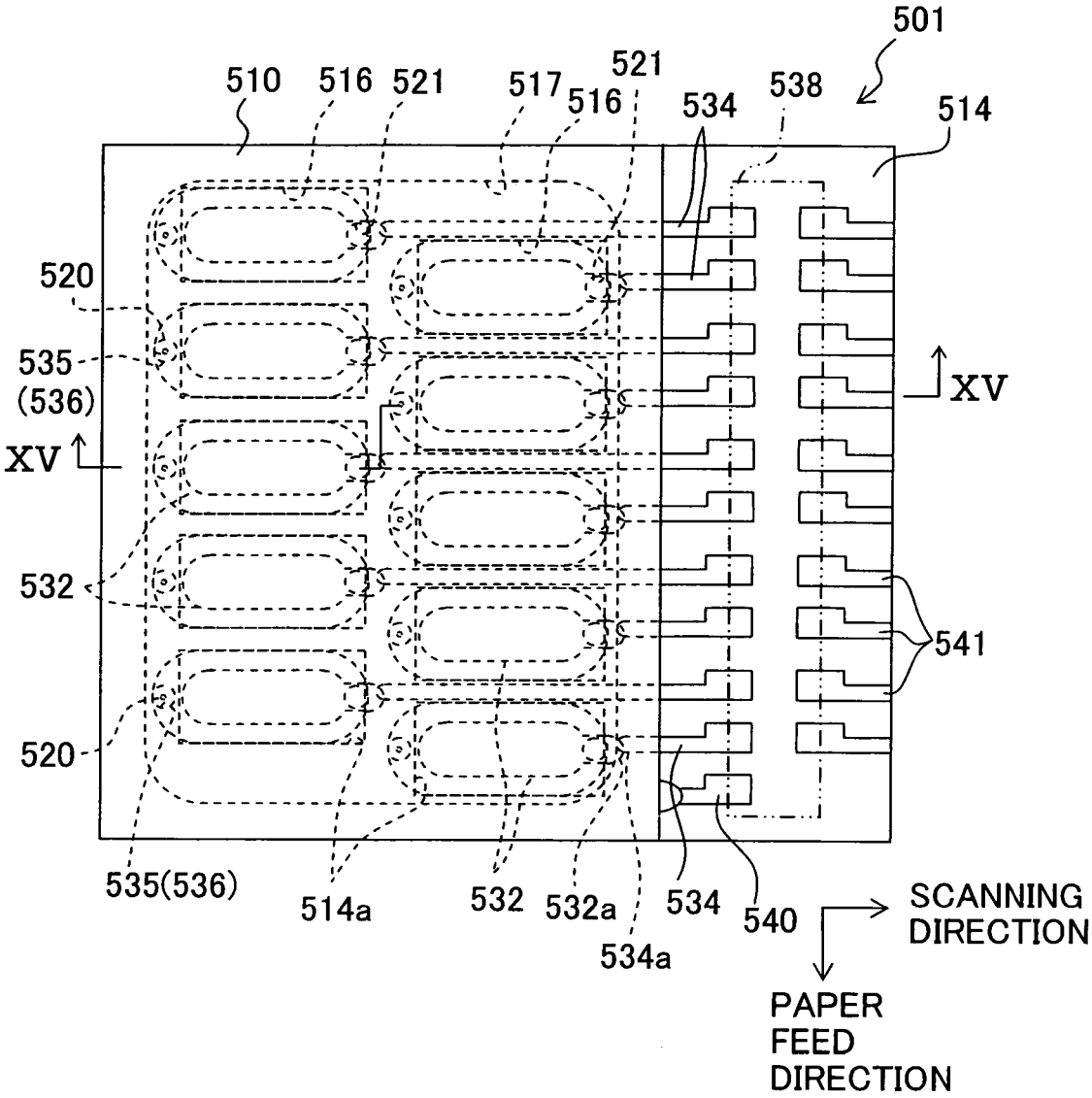
FIG. 14 shows a plan view illustrating an ink-jet head according to a second embodiment of the present invention.

At first, an explanation will be made successively about the plates other than the piezoelectric actuator 503. The manifold 517, which is continued to the plurality of pressure chambers 516, is formed in the two manifold plates 510, 511. As shown in FIGS. 14 and 15, the manifold 517 is formed so that the manifold 517 is overlapped with all of the plurality of pressure chambers 516 as viewed in a plan view. The ink is supplied to the manifold 517 from an unillustrated ink supply source via an ink supply hole 518. A filter 519, which removes any dust or the like mixed with the ink in the manifold 517, is provided between the two manifold plates 510, 511. The base plate 512 is formed with a plurality of communication holes 521 which make communication between the manifold 517 and the plurality of pressure chambers 516 respectively.

The pressure chamber plate 513 is formed with a plurality of pressure chambers 516 which are arranged along a flat surface as shown in FIG. 14. The plurality of pressure chambers 516 are arranged in two arrays in the paper feed direction (vertical direction as shown in FIG. 14). Each of the pressure chambers 516 is formed to be substantially elliptical as viewed in a plan view. The pressure chambers 516 are arranged so that the major axis direction thereof resides in the left and right directions (scanning direction). The respective pressure chambers 16 are communicated with the manifold 517 via the communication holes 521 formed in the base plate 512 at the rightward ends as shown in FIG. 14.

Figure 16:
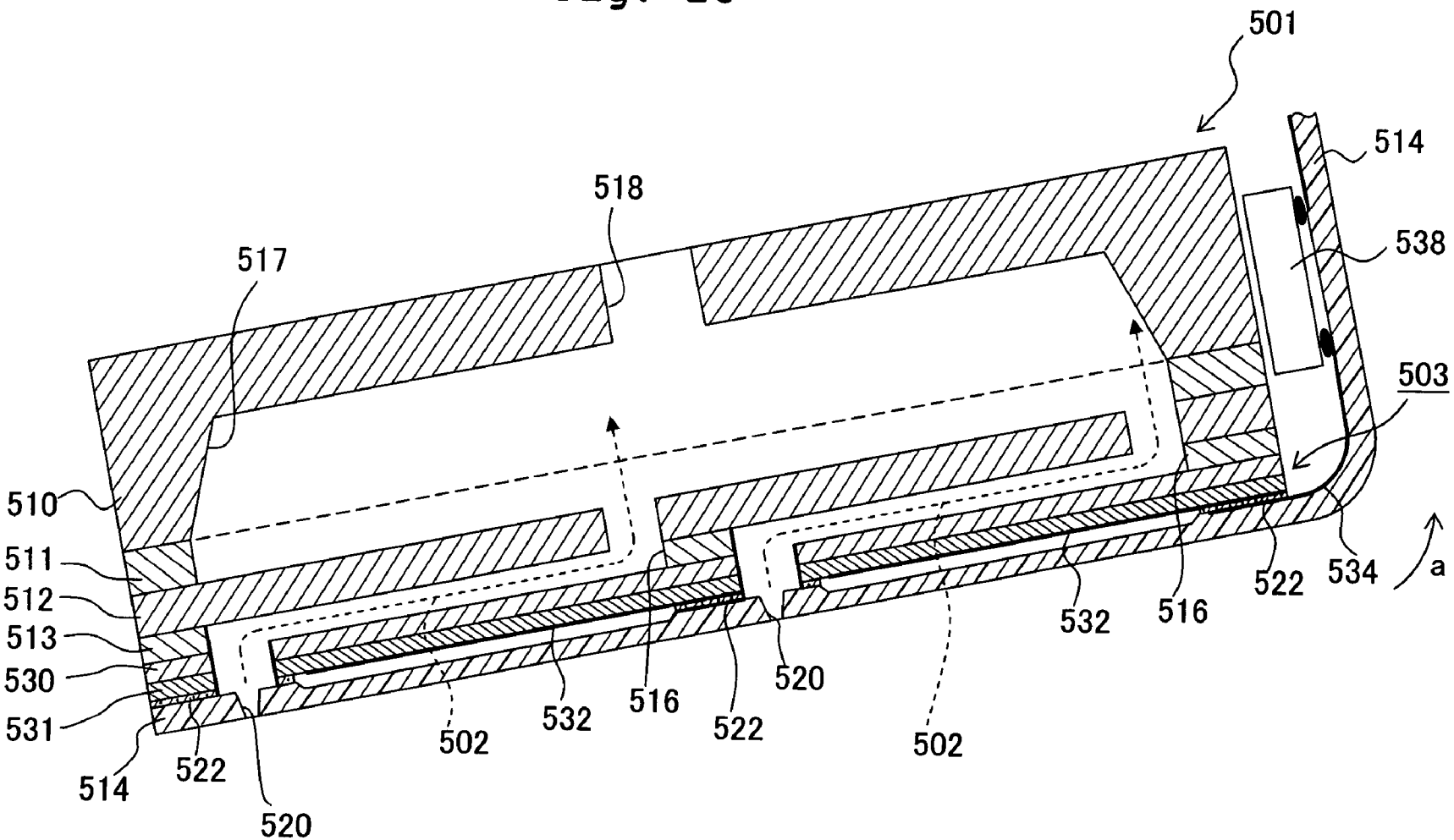
FIG. 16 shows a sectional view illustrating the ink-jet head arranged in an inclined state, corresponding to FIG. 15.
Figure 17:
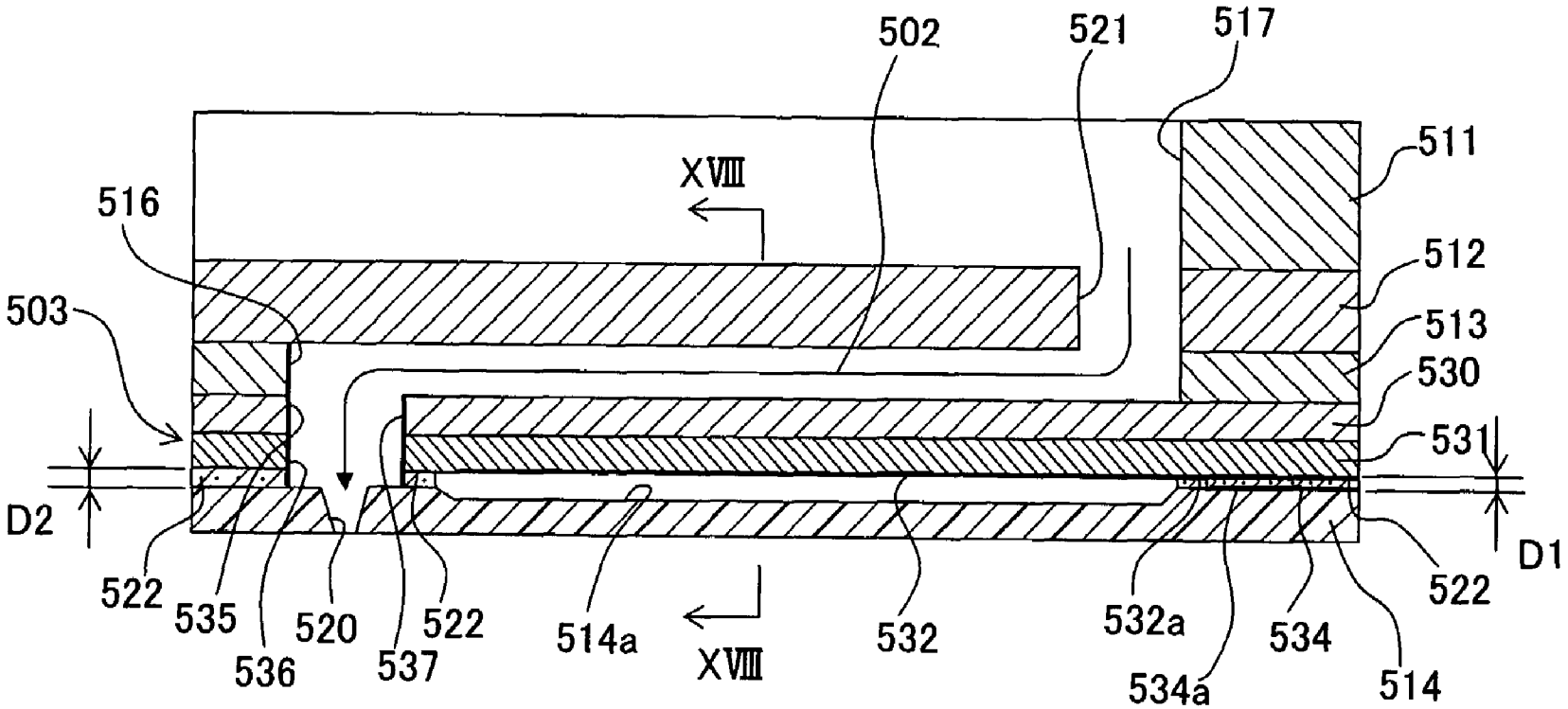
FIG. 17 shows a partial magnified view illustrating those shown in FIG. 16.
Figure 18:
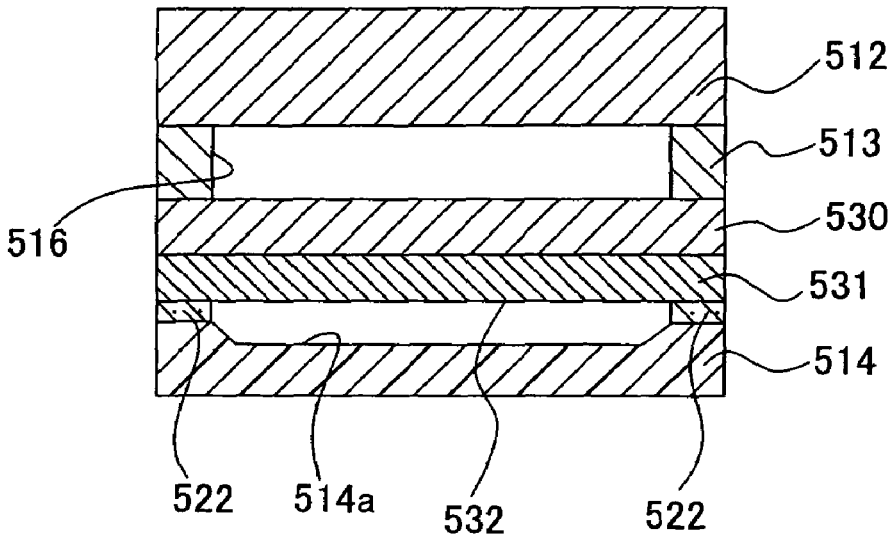
FIG. 18 shows a sectional view taken along a line XVIII-XVIII shown in FIG. 17.
Figure 19:
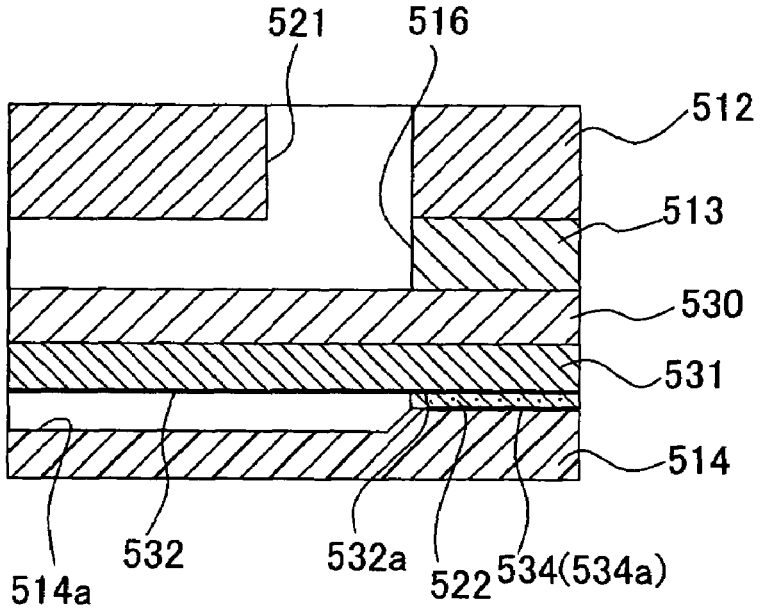
FIG. 19 shows a magnified view illustrating major parts shown in FIG. 17.

A plurality of nozzles 520, which are directed downwardly in the vertical direction, are formed at positions of the nozzle plate 514 respectively at which the leftward ends of the plurality of pressure chambers 516 shown in FIG. 14 are overlapped as shown in a plan view. As shown in FIGS. 15 to 17, the nozzle plate 514 is adhered to the surface of the piezoelectric actuator 503 on the side opposite to the pressure chambers 516 by an adhesive 522 which is composed of an anisotropic conductive material that has the conductivity in a compressed state. The piezoelectric actuator 503 is arranged between the pressure chamber plate 513 and the nozzle plate 514. The manifold 517 and the pressure chambers 516 are arranged on the side mutually opposite to the nozzles 520 with the piezoelectric actuator 503 intervening therebetween. As described above, the manifold 517 is arranged on the side opposite to the nozzles 520 in relation to the piezoelectric actuator 503. Therefore, the area, in which the nozzles 520 can be arranged, is widened to enhance the degree of freedom of the arrangement. It is possible to arrange the nozzles 520 at a higher density. The nozzles 520 are directed downwardly in the vertical direction. The manifold 517 is arranged at the upper position in the vertical direction as compared with the nozzles 520. Therefore, any bubble, with which the individual ink flow passage 502 is contaminated, is easily moved to the manifold 517 in accordance with the buoyancy of itself. It is easy to discharge the bubble toward the manifold 517. Further, as shown in FIG. 16, when the ink-jet head 501 is arranged while being slightly inclined in the direction of the arrow "a" with respect to the surface (horizontal surface) on which the ink-jet printer 100 is installed, and the nozzles 520 are directed obliquely downwardly, then the bubbles contained in the individual ink flow passage 502 tend to be moved to the manifold 517 more promptly as indicated by broken line arrows.

When the manifold 517 is arranged at the upper position in the vertical direction as compared with the nozzles 520 as described above, the bubble, with which the individual ink flow passage 502 is contaminated, is easily moved to the manifold 517 by the aid of the buoyancy thereof. In particular, as shown in FIG. 16, when the portions of the individual ink flow passages 502, which are disposed on the more upstream side along with the flow of the ink, are formed to extend upwardly in the vertical direction, the bubble, with which the individual ink flow passage 502 is contaminated, can be moved to the manifold 517 more reliably. That is, when the ink-jet head 501 is arranged while being inclined with respect to the horizontal plane, the bubble, with which the individual ink flow passage 502 is contaminated, can be moved to the manifold 517 more reliably.

The pressure chambers 516 formed in the pressure chamber plate 513 are communicated with the nozzles 520 formed in the nozzle plate 514 via through-holes 535, 536 formed through the vibration plate 530 and the piezoelectric layer 531 of the piezoelectric actuator 503 respectively. A plurality of wiring sections 534, which are connected to a plurality of individual electrodes 532 respectively and which extend in one of the scanning directions (rightward direction as shown in FIG. 14), are formed on the surface of the nozzle plate 514 on the side of the piezoelectric actuator 503. Further, a driver IC 538, which is connected to the plurality of wiring sections 534, is arranged on the surface of the nozzle plate 514 on which the plurality of wiring sections 534 are formed. The wiring sections 534 and the driver IC 538 will be explained in detail later on. As shown in FIGS. 15 and 17, the individual ink flow passages 502, which extend from the manifold 517 via the pressure chambers 516 and which penetrate through the piezoelectric actuator 503 to arrive at the nozzles 520, are formed in the ink-jet head 501.

Next, the piezoelectric actuator 503 will be explained. As shown in FIGS. 14 to 19, the piezoelectric actuator 503 includes the vibration plate 530 which covers the lower portions of the plurality of pressure chambers 516, the piezoelectric layer 531 which is formed on the surface of the vibration plate 530 on the side opposite to the plurality of pressure chambers 516, and the plurality of individual electrodes 532 which are formed at the positions opposed to the plurality of pressure chambers 516 respectively on the surface of the piezoelectric layer 531 disposed on the side opposite to the vibration plate 530.

The vibration plate 530 is a metal plate which is substantially rectangular as viewed in a plan view. The vibration plate 530 is composed of, for example, iron-based alloy such as stainless steel, copper-based alloy, nickel-based alloy, or titanium-based alloy. The vibration plate 530 is joined to the lower surface of the pressure chamber plate 513 so that the plurality of pressure chambers 516 are closed thereby. The vibration plate 530 also serves as a common electrode which is opposed to the plurality of individual electrodes 532 and which allows the electric field to act on the piezoelectric layer 531 between the individual electrodes 532 and the vibration plate 530. The vibration plate 530 is retained at the ground electric potential by the aid of the wiring sections 540 (see FIG. 14). The piezoelectric layer 531 is formed on the lower surface of the vibration plate 530. The piezoelectric layer 531 contains a major component of lead zirconate titanate (PZT) which is a ferroelectric substance and which is a solid solution of lead titanate and lead zirconate. The piezoelectric layer 531 is formed continuously to extend over the plurality of pressure chambers 516.

The through-holes 535, 536, which constitute parts of the individual ink flow passages 502 respectively, are formed at the positions of the vibration plate 530 and the piezoelectric layer 531 overlapped with the leftward ends of the pressure chambers 516 as viewed in a plan view as shown in FIG. 14. The individual ink flow passages 502 penetrate through the piezoelectric actuator 503 at the through-holes 535, 535 to make communication between the pressure chambers 516 and the nozzles 520. In such an arrangement, if the piezoelectric layer 531 is exposed to the individual ink flow passages 502 at the through-holes 536, there is such a possibility that the ink having conductivity may be permeated into the piezoelectric layer 531, and any short circuit may be formed by the ink between the plurality of individual electrodes 532. Accordingly, the ink-jet head of the embodiment of the present invention has protective films 537 which are formed on the surfaces which define the through-holes 535, 536 in order to avoid the permeation, into the piezoelectric layer 531, of the ink flowing through the individual ink flow passages 502. The protective film 537 is composed of, for example, silicon oxide or silicon nitride.

The plurality of individual electrodes 532, each of which has an elliptical planar shape slightly smaller than the pressure chamber 516 as a whole, are formed on the lower surface of the piezoelectric layer 531. The plurality of individual electrodes 532 are formed at the positions at which they are overlapped with the central portions of the corresponding pressure chambers 516 respectively as viewed in a plan view. The individual electrode 532 is composed of a conductive material such as gold. As shown in FIGS. 14 to 17 and 19, a plurality of contact sections 532*a*, which are electrically connected to the driver IC 538 via the plurality of wiring sections 534 formed on the nozzle plate 514 respectively, extend from the ends of the plurality of individual electrodes 532 in the longitudinal direction (rightward ends as shown in FIGS. 14 to 17 and 19) to areas in which the contact sections 532*a* are not overlapped with the pressure chambers 516 as viewed in a plan view. The driving voltage is selectively applied to the plurality of individual electrodes 532 from the driver IC 538 via the plurality of wiring sections 534 and the contact sections 532*a*.

Next, an explanation will be made about the function of the piezoelectric actuator 503. When the driving voltage is selectively applied from the driver IC 538 to the plurality of individual electrodes 532, a state is given, in which the electric potential differs between the individual electrode 532 disposed on the upper side of the piezoelectric layer 531 supplied with the driving voltage and the vibration plate 530 as the common electrode disposed on the lower side of the piezoelectric layer 531 retained at the ground electric potential. The electric field in the vertical direction is generated in the portion of the piezoelectric layer 531 interposed between the individual electrode 532 and the vibration plate 530. Accordingly, the portion of the piezoelectric layer 531, which is disposed just under the individual electrode 532 applied with the driving voltage, is shrunk in the horizontal direction which is perpendicular to the vertical direction as the polarization direction. In this situation, the vibration plate 530 is deformed so that the vibration plate 530 is convex toward the pressure chamber 516 in accordance with the shrinkage of the piezoelectric layer 531. Therefore, the volume in the pressure chamber 516 is decreased, and the pressure is applied to the ink contained in the pressure chamber 516. Thus, the ink is jetted from the nozzle 520 communicated with the pressure chamber 516.

The nozzle plate 514 is formed of the insulating material having the flexibility. As shown in FIGS. 14 to 17 and 19, the plurality of wiring sections 534*a*, which has the terminal sections 534*a*, which are connected to the contact sections 532*a* of the plurality of individual electrodes 0.532 respectively at the ends (leftward ends as shown in FIG. 14) on the surface of the nozzle plate 514 disposed on the side of the piezoelectric actuator 503, and which extend in one direction of the scanning directions (rightward direction as shown in FIG. 14), are formed. The ends of the plurality of wiring sections 534, which are disposed on the side opposite to the individual electrodes 534, are connected to the driver IC 538. The driver IC 538 is arranged on the nozzle plate 514. As described above, the plurality of individual electrodes 532 and the driver IC 538 are electrically connected to one another by the aid of the plurality of wiring sections 534 which are formed on the nozzle plate 514. Therefore, any wiring member such as FPC, which has been hitherto required, is unnecessary. It is possible to decrease the number of parts, and it is possible to reduce the production cost of the ink-jet head 501. Further, the nozzle plate 514 is formed of the insulating material having the flexibility. Therefore, the nozzle plate 514 can be subjected to the flexible arrangement as shown in FIGS. 15 and 16, in the same manner as the flexible wiring member such as FPC having been hitherto used. Thus, it is possible to enhance the degree of freedom of the arrangement of the driver IC 538 or the like.

As shown in FIG. 14, a wiring section 540 is formed on the surface of the nozzle plate 514 on which the plurality of wiring sections 534 are formed in order that the vibration plate 530 as the common electrode is retained at the ground electric potential by the aid of the driver IC 538. Further, as shown in FIGS. 14 and 15, a plurality of wiring sections 541, which connect the driver IC 538 and a control unit (not shown) of the ink-jet printer 100, are also formed on the nozzle plate 514.

In this arrangement, the nozzle plate 514 is adhered by the adhesive 522 composed of an anisotropic conductive film (ACF) or an anisotropic conductive paste (ACP). The anisotropic conductive material is obtained, for example, by dispersing conductive particles in a thermosetting epoxy resin. The anisotropic conductive material has an insulating property in an uncompressed state, and it has a conductive property in a compressed state. The adhesive 522 is compressed to have the conductivity in the connection area between the contact sections 532*a* of the individual electrodes 532 and the terminal sections 534*a* of the wiring sections 534, in which the contact sections 532*a* and the terminal sections 534*a* are electrically connected to one another by the adhesive 522. However, the adhesive 522 is not compressed to have the insulating property in the portions other than the electric connecting portions between the contact sections 532*a* and the terminal sections 534*a*. Therefore, it is possible to suppress the generation of any unnecessary capacitance in the piezoelectric layer 532 interposed between the wiring section 534 and the vibration plate 530 at the portion other than the electric connecting portion between the contact section 532*a* and the terminal section 534*a*. Accordingly, the driving efficiency of the piezoelectric actuator 503 is improved.

As shown in FIG. 17, the spacing distance (D1 shown in FIG. 17) between the contact section 532*a* of the individual electrode 532 and the terminal section 534*a* of the wiring section 534 formed on the nozzle plate 14 is smaller than the spacing distance (D2 shown in FIG. 17) between the nozzle plate 514 and the piezoelectric layer 531 at any portion other than the above. Therefore, when the nozzle plate 514 is pressed against the piezoelectric layer 531 to adhere the nozzle plate 514 and the piezoelectric layer 531 to one another, it is easy that only the adhesive 522, which is disposed between the contact sections 532*a* of the individual electrodes 532 and the terminal sections 534*a* of the wiring sections 534, is compressed to electrically connect the individual electrodes 532 and the wiring sections 534.

Further, as shown in FIGS. 14 to 17, a plurality of recesses 514*a*, each of which has a rectangular planar shape, are formed at portions of the nozzle plate 514 opposed to the plurality of individual electrodes 532. Therefore, when the driving voltage is applied to the individual electrode 532 to deform the piezoelectric layer 531, then the deformation of the piezoelectric layer 531 is not inhibited by the nozzle plate 514 and the adhesive 522 for adhering the nozzle plate 514 and the piezoelectric layer 531, and thus the driving efficiency of the piezoelectric actuator 503 is improved. The recesses 514*a* are not formed commonly to extend over the plurality of individual electrodes 532. As shown in FIG. 14, the plurality of recesses 514*a* are individually formed for the plurality of individual electrodes 532 respectively. Therefore, the rigidity of the nozzle plate 514 is secured to some extent by the portions which are disposed between the recesses 514*a*. Accordingly, it is possible to avoid the flexible bending of the nozzle plate 514, for example, when the ink-jetting surface (lower surface of the nozzle plate 514) is wiped with a wiper or the like after the purge operation (bubble discharge operation) from the nozzles 520. Further, as shown in FIG. 14, the plurality of wiring sections 534 are formed in the areas between the plurality of recesses 514*a*, i.e., in the areas in which the plurality of wiring sections 534 are not opposed to the plurality of nozzles 520 and the plurality of pressure chambers 516. Therefore, the conductive ink is not adhered to the wiring sections 534. It is possible to avoid any short circuit which would be otherwise formed between the wiring sections 534. When the driving voltage is applied to the individual electrode 532, the wiring section 534 does not inhibit the deformation of the piezoelectric layer 531 as well.

Figure 20A:
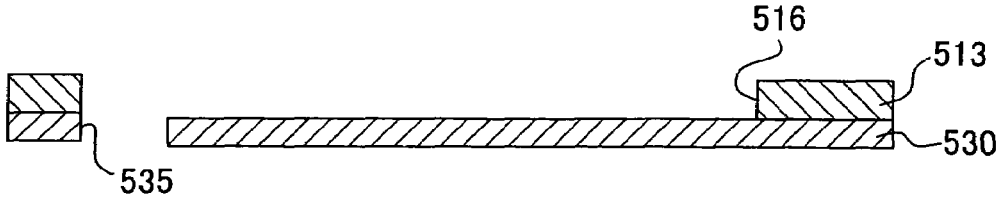
FIG. 20A shows a joining step of joining a pressure chamber plate and a vibration plate.

Next, an explanation will be made about a method for producing the ink-jet head 501 described above. At first, an explanation will be made with reference to FIG. 20 about steps of stacking a plurality of plates (including the vibration plate 530 and the piezoelectric layer 531 of the piezoelectric actuator 503) other than the nozzle plate 514. At first, as shown in FIG. 20A, the through-holes 535, which constitute parts of the individual ink flow passages 502, are formed through the vibration plate 530, for example, by means of the etching (a hole-forming step). The pressure chamber plate 513, in which the pressure chambers 516 are formed, is joined to the vibration plate 530 by means of the metal diffusion bonding or the adhesive.

Figure 20B:
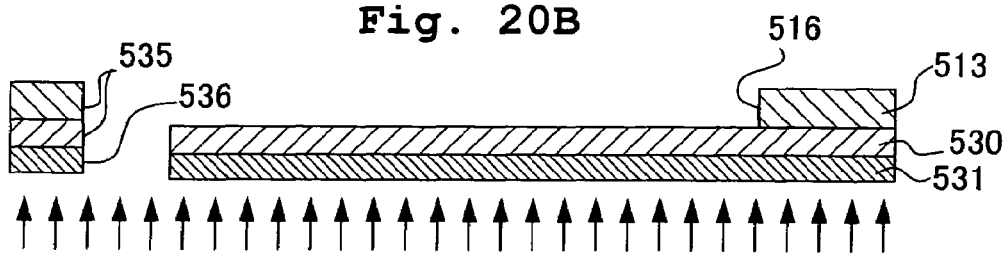
FIG. 20B shows a piezoelectric layer-forming step.

Subsequently, as shown in FIG. 20B, particles of the piezoelectric element are deposited on the surface of the vibration plate 530 disposed on the side opposite to the pressure chamber plate 513, and the heat treatment is applied. Accordingly, the piezoelectric layer 531 is formed in only the area of the vibration plate 530 in which the through-holes 535 are not formed (a piezoelectric layer-forming step). The following method is available to deposit the piezoelectric element on the vibration plate 530. That is, the piezoelectric element can be formed by using, for example, the aerosol deposition method (AD method) in which a superfine particle material is collided and deposited at a high speed. Alternatively, it is also possible to use the sputtering method and the CVD (chemical vapor deposition) method. When the piezoelectric layer 531 is formed by depositing the piezoelectric element particles on the vibration plate 530, the through-holes 536, which constitute parts of the individual ink flow passages 502 in the same manner as the through-holes 535, are simultaneously formed at the positions of the piezoelectric layer 531 corresponding to the through-holes 535 of the vibration plate 530.

Figure 20C:
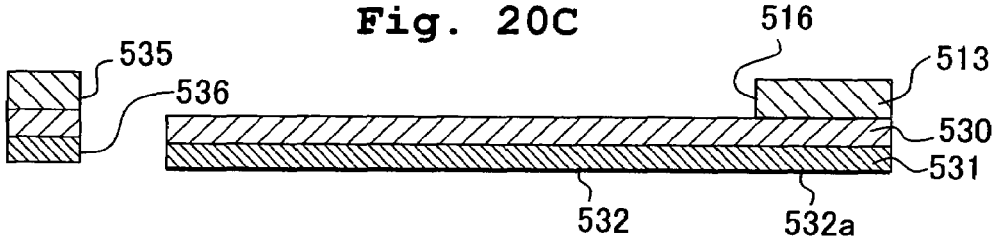
FIG. 20C shows an individual electrode-forming step.
Figure 20D:
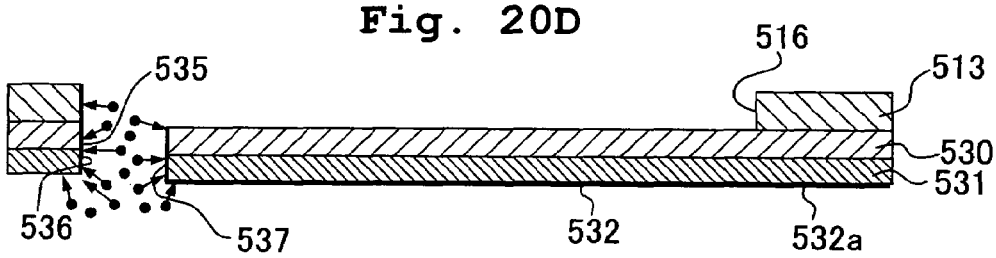
FIG. 20D shows a protective film-forming step.
Figure 20E:
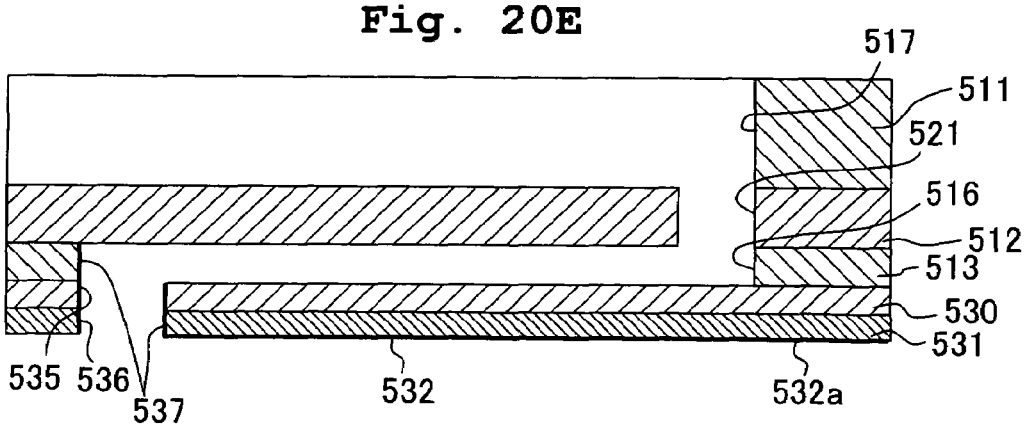
FIG. 20E shows a joining step of joining a manifold plate and a base plate.

As shown in FIG. 20C, the individual electrodes 532 are formed by using the screen printing or the vapor deposition method in the area opposed to the pressure chambers 516 on the surface of the piezoelectric layer 531 disposed on the side opposite to the vibration plate 530. Further, the contact sections 532*a*, which are continued to the individual electrodes 532, are formed. Further, as shown in FIG. 20D, the protective films 537, which prevent the ink from being permeated into the piezoelectric layer 531, are formed by using the AD method, the sputtering method, or the CVD method on the surfaces which define the through-holes 535, 536 formed through the vibration plate 530 and the piezoelectric layer 531 (a protective film-forming step). The base plate 512 and the two manifold plates 510, 511 are joined to the surface of the pressure chamber plate 513 disposed on the side opposite to the piezoelectric actuator 503. Alternatively, the five plates made of metal, i.e., the two manifold plates 510, 511, the base plate 512, the pressure chamber plate 513, and the vibration plate 530 may be previously joined at once by means of, for example, the diffusion bonding, and then the piezoelectric layer 531 may be formed on the surface of the vibration plate 530 disposed on the side opposite to the pressure chambers 516.

Figure 21A:
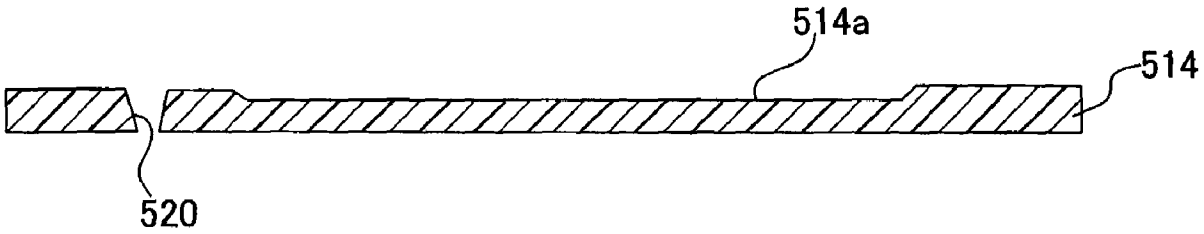
FIG. 21A shows a step of forming nozzles and recesses.
Figure 21B:
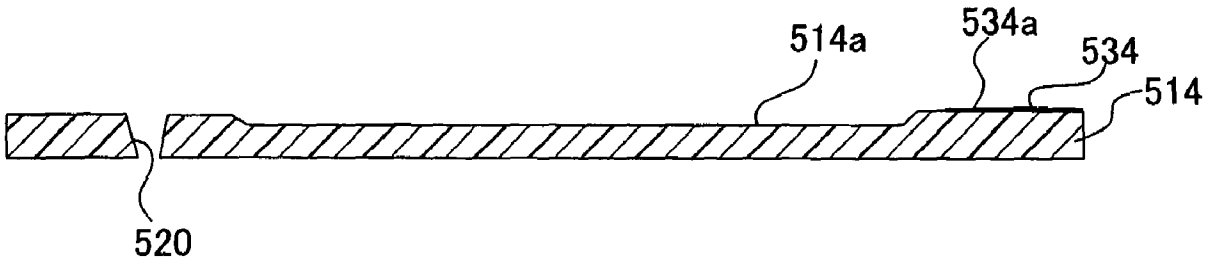
FIG. 21B shows a step of forming wiring sections.
Figure 21C:
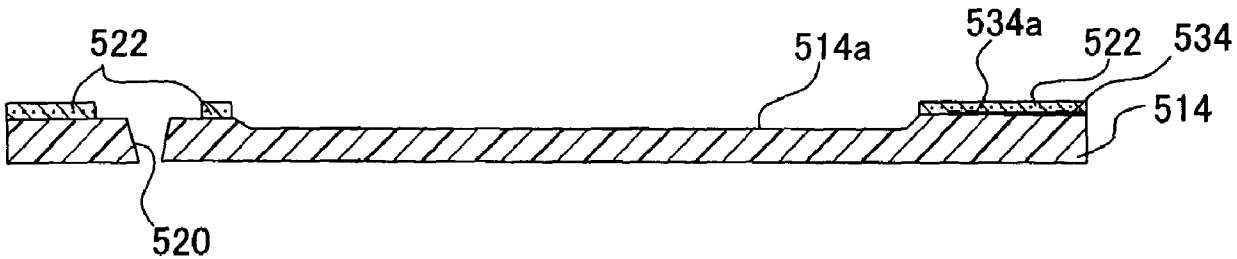
FIG. 21C shows a step of sticking an adhesive.

Next, an explanation will be made with reference to FIG. 21 about steps of forming the nozzle plate 514. As shown in FIG. 21A, the plurality of recesses 514*a* are formed in the areas to be opposed to the plurality of individual electrodes 532 respectively when the nozzle plate 514 is adhered to the piezoelectric layer 531. Further, the plurality of nozzles 520 are formed by means of, for example, the excimer laser processing. Subsequently, as shown in FIG. 21B, the wiring sections 534 (and the terminal sections 534*a*), which extend in the rightward direction, are formed on the portions disposed on the right side from the recesses 514*a*. As shown in FIG. 21C, the adhesive 522, which is composed of the anisotropic conductive material, is stuck by means of, for example, the screen printing onto the upper surface of the nozzle plate 514 to be adhered to the piezoelectric layer 531 (a sticking step). In the sticking step, the adhesive 522 may be stuck by effecting the patterning to only the portions of the nozzle plate 514 to be adhered to the piezoelectric layer 531. However, the adhesive 522 may be stuck to the entire surface of the nozzle plate 514. Also in this case, the deformation of the piezoelectric layer 531, which is brought about when the driving voltage is applied to the individual electrode 532, is not inhibited by the nozzle plate 514 and the adhesive 522 stuck to the nozzle plate 514, because the recesses 514*a* are formed at the portions of the nozzle plate 514 opposed to the individual electrodes 532.

Figure 22:
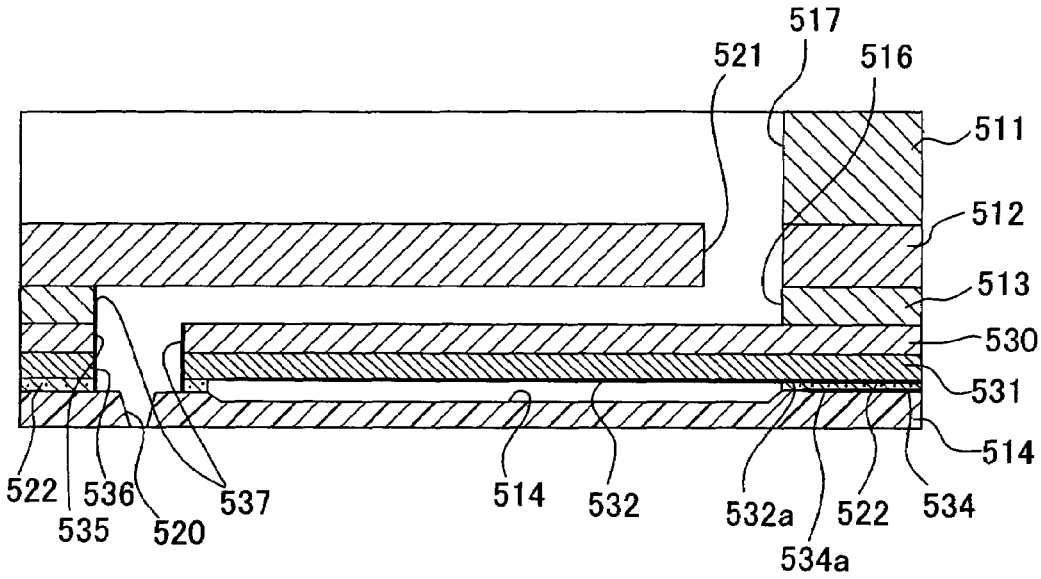
FIG. 22 shows a state in which the nozzle plate is adhered to the plurality of stacked plates other than the nozzle plate.

As shown in FIG. 22, the nozzle plate 514 is adhered by the adhesive 522 to the piezoelectric layer 531 of the piezoelectric actuator 503 (an adhering step). In this procedure, the contact sections 532*a* of the individual electrodes 532 are allowed to make contact with the adhesive 522 stuck to the surfaces of the terminal sections 534*a* of the wiring sections 534. The adhesive 522 of these portions is compressed to connect the individual electrodes 532 and the wiring sections 534 in the conducting state, and the other portions of the wiring sections 534 are adhered to the piezoelectric layer 531 in the insulating state by means of the adhesive 522 which is not compressed. Simultaneously, the adhesive 522, which is stuck to the portions of the nozzle plate 514 other than the wiring sections 534, is used to adhere the nozzle plate 514 and the piezoelectric layer 531. Each of the individual electrode 532 and the wiring section 534 has a thickness of about 5 μm. Therefore, the spacing distance (D1 as shown in FIG. 17) between the contact sections 532*a* of the individual electrodes 532 and the terminal sections 534*a* of the wiring sections 534 formed on the nozzle plate 514 is smaller than the spacing distance (D2 as shown in FIG. 17) between the nozzle plate 514 and the piezoelectric layer 531 at the portions other than the above. Therefore, when the nozzle plate 514 is adhered to the piezoelectric layer 531 of the piezoelectric actuator 503, only the adhesive 522, which is disposed between the contact sections 532*a* of the individual electrodes 532 and the terminal sections 534*a* of the wiring sections 534, can be compressed by merely pressing the nozzle plate 514 against the piezoelectric layer 531 uniformly. It is easy to electrically connect the individual electrodes 532 and the wiring sections 534.

Alternatively, the thickness of the portions around the nozzles 520 (left end portion of the nozzle plate 514 as shown in FIG. 21) may be made slightly thinner than the thickness of the portions at which the wiring sections 534 are formed (right end portion of the nozzle plate 514 as shown in FIG. 21). Accordingly, the spacing distance (D1 as shown in FIG. 17) between the contact sections 532*a* of the individual electrodes 532 and the terminal sections 534*a* of the wiring sections 534 formed on the nozzle plate 514 may be made smaller than the spacing distance (D2 as shown in FIG. 17) between the nozzle plate 514 and the piezoelectric layer 531 at the portions other than the above.

According to the ink-jet head 501 and the method for producing the same as explained above, the following effect is obtained. The plurality of wiring sections 534 for connecting the plurality of individual electrodes 532 of the piezoelectric actuator 503 and the driver IC 538 for supplying the driving voltage to the plurality of individual electrodes 532 are formed on the nozzle plate 514 composed of the insulating material. The nozzle plate 514 can be allowed to have the function of the wiring member such as FPC to dispense with the wiring member. Therefore, it is possible to decrease the number of parts, and it is possible to reduce the production cost of the ink-jet head 501. Additionally, the driver IC 538 can be arranged on the nozzle plate 514. Further, the nozzle plate 514 can be subjected to the flexible arrangement in the same manner as FPC or the like, because the nozzle plate 514 has the flexibility. The degree of freedom of the arrangement of the driver IC 538 is enhanced. Furthermore, the nozzle plate 514 can be adhered to the piezoelectric actuator 503, simultaneously with which the plurality of individual electrodes 532 and the plurality of wiring sections 534 can be electrically connected to one another. It is possible to simplify the production steps for producing the ink-jet head 501.

The piezoelectric layer 531 and the nozzle plate 514 are adhered by the adhesive 522 composed of the anisotropic conductive material in the step of adhering the nozzle plate 514 and the piezoelectric layer 531 of the piezoelectric actuator 503. Therefore, the electric connection between the individual electrodes 532 and the wiring sections 534 can be performed at once by using the one type of the adhesive 522. It is possible to further simplify the production steps, and it is possible to reduce the production cost. Further, the adhesive 522, which is disposed between the individual electrodes 532 and the wiring sections 534, is compressed to have the conductivity, but the adhesive 522, which is disposed at the other portions, is not compressed to have the insulating property. Therefore, it is possible to suppress the generation of any unnecessary capacitance in the piezoelectric layer 531 interposed between the wiring sections 534 and the vibration plate 530 at the portions other than the electric connecting portions between the individual electrodes 532 and the wiring sections 534. Thus, the driving efficiency of the piezoelectric actuator 503 is improved.

Next, an explanation will be made about modified embodiments in which the second embodiment described above is variously changed. However, those having the same construction as that of the embodiment described above are designated by the same reference numerals, any explanation of which will be appropriately omitted.

First Modified Embodiment

Figure 23:
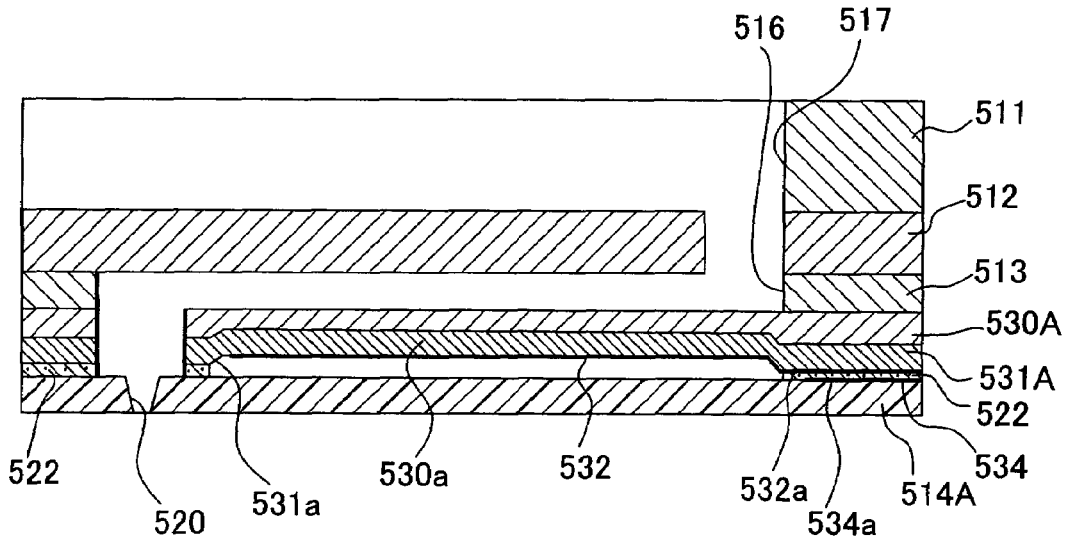
FIG. 23 shows a sectional view illustrating a first modified embodiment, corresponding to FIG. 17.

In the second embodiment described above, the recesses are formed at the portions of the nozzle plate opposed to the individual electrodes 532. However, recesses may be formed on the side of the piezoelectric layer. For example, as shown in FIG. 23, a plurality of recesses 530*a* may be formed at portions of a vibration plate 530A opposed to the plurality of individual electrodes 532 respectively, and recesses 531*a*, which correspond to the recesses 530*a* of the vibration plate 530A, may be formed on a piezoelectric layer 531A. In this arrangement, the piezoelectric layer 531A is formed to have a uniform thickness by means of, for example, the AD method or the CVD method on the surface of the vibration plate 530A formed with the recesses 530*a*. Accordingly, the recesses 531*a* of the piezoelectric layer 531A can be simultaneously formed. In this procedure, the adhesive 522 is stuck to the piezoelectric layer 531A, and then the nozzle plate 514A is adhered to the piezoelectric layer 531A.

Second Modified Embodiment

Figure 24:
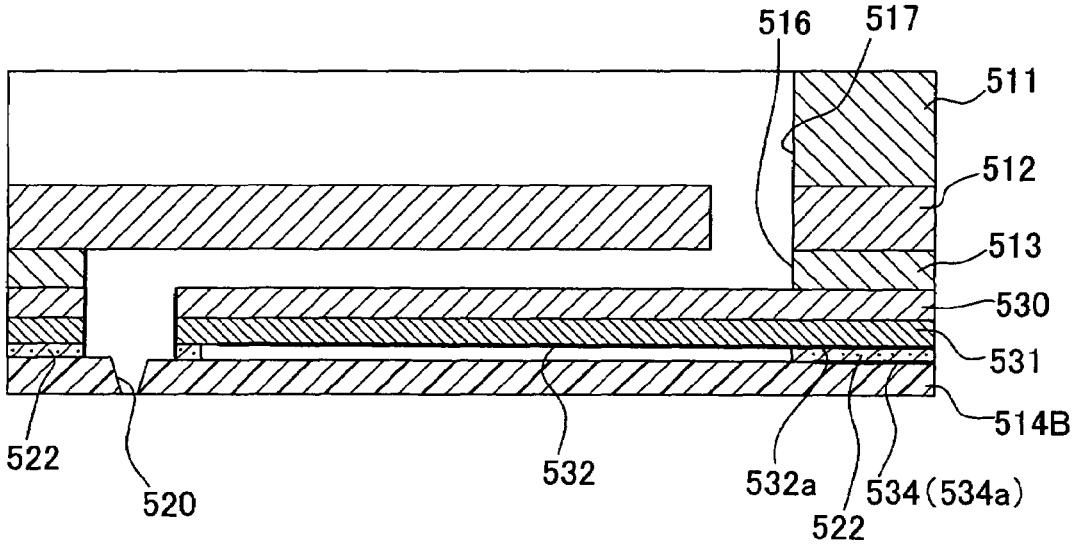
FIG. 24 shows a sectional view illustrating a second modified embodiment, corresponding to FIG. 17.

When the adhesive 522 is stuck by effecting the patterning in the sticking step of sticking the adhesive 522 to the nozzle plate 514 (or the piezoelectric layer 531), the gap is formed by the adhesive 522 between the nozzle plate 514 and the piezoelectric layer 531. Owing to the gap, the deformation of the piezoelectric layer 531 is hardly inhibited by the nozzle plate 514 and the adhesive 522 stuck to the nozzle plate 514. Therefore, as shown in FIG. 24, it is also allowable to omit the recesses of the nozzle plate 514B (or the piezoelectric layer 531). In order to stick the adhesive 522 by effecting the patterning, the following procedure can be also adopted other than the screen printing as described above. That is, the adhesive 522 is stuck to the entire surface of the nozzle plate 514 (514B), and then the adhesive 522, which is disposed at portions at which no adhesion is effected with respect to the piezoelectric layer 531, is partially removed by means of, for example, the laser.

Third Modified Embodiment

The electric connection between the contact sections 532*a* of the individual electrodes 532 formed on the piezoelectric layer 531 and the terminal sections 534*a* of the wiring sections 534 formed on the nozzle plate 514, and the adhesion of the piezoelectric layer 531 and the nozzle plate 514 at the portions other than the electric connecting portions can be also performed by using distinct adhesive materials. For example, a conductive paste may be used for the electric connection between the individual electrodes 532 and the wiring sections 534, and a non-conductive adhesive may be used for the adhesion of the piezoelectric layer 531 and the nozzle plate 514 at the other portions. However, in this case, it is preferable that the conductive paste and the non-conductive adhesive, which have their curing temperatures close to one another, are used in order to simultaneously perform the electric connection between the individual electrodes 532 and the wiring section 534 and the adhesion of the piezoelectric layer 531 and the nozzle plate 514.

Fourth Modified Embodiment

The following procedure is also available. That is, a nozzle plate is formed with a metal material such as stainless steel. A thin film of an insulating material such as alumina is formed on one surface of the metal plate by means of, for example, the AD method, the sputtering method, or the CVD method. Accordingly, the nozzle plate is allowed to have an insulating property on the surface on which the thin film is formed. In this case, the surface of the nozzle plate, on which the thin film is formed, may be used as the surface which is opposed to the piezoelectric actuator 503 and on which the plurality of wiring sections 534 are formed.

Fifth Modified Embodiment

Figure 25:
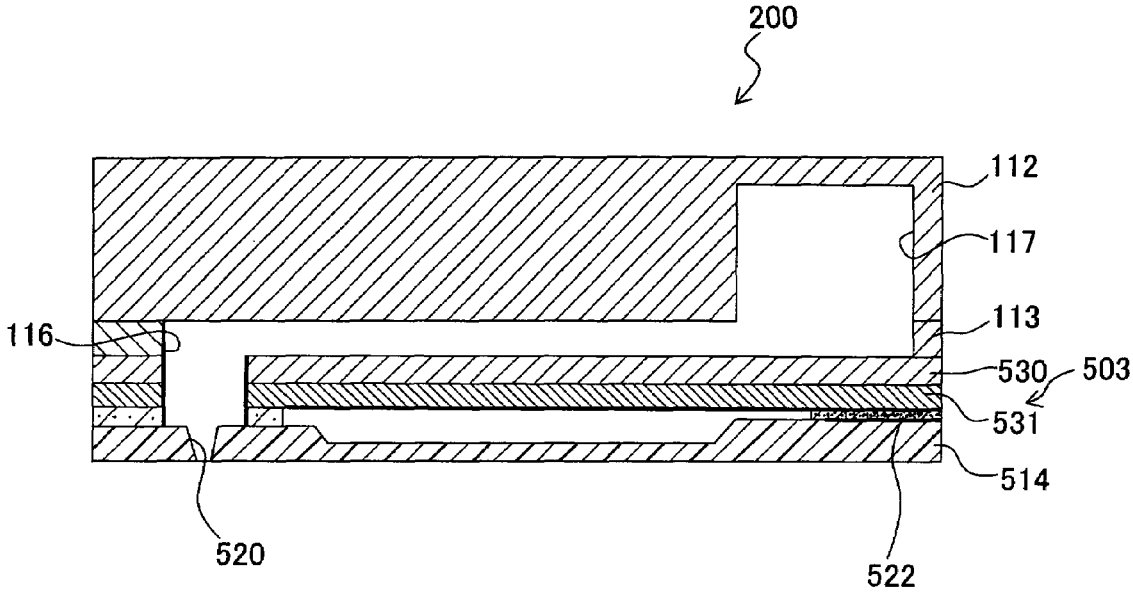
FIG. 25 shows an ink-jet head having a manifold arranged adjacently to pressure chambers, corresponding to FIG. 17.

In the embodiment described above, the manifold is formed at the upper position of the base plate, and the pressure chambers are formed at the lower positions of the base plate. However, the position of the manifold is not limited to the position over the pressure chambers. A part of the manifold may be formed at the same level (height) as that of the pressure chambers. For example, the lower surfaces of the pressure chambers may have the same level as that of the lower surface of the manifold. An ink-jet head 200 shown in FIG. 25 includes a manifold plate 112 in which a manifold 117 is formed, a pressure chamber plate 113 in which pressure chambers 116 are formed, the piezoelectric actuator 503 which has the vibration plate 530 and the piezoelectric layer 531, the anisotropic conductive layer 522, and the nozzle plate 514. The manifold plate 112 is joined to the surface of the piezoelectric actuator 503 on the side of the vibration plate 530 with the pressure chamber plate 113 intervening therebetween. The nozzle plate 514 is joined to the surface of the piezoelectric actuator 503 on the side of the piezoelectric layer 531 with the anisotropic conductive layer 522 intervening therebetween. In this arrangement, the vibration plate 530 defines the lower surfaces of the pressure chambers 116, and the vibration plate 530 also defines the lower surface of the manifold 117. That is, the lower surfaces of the pressure chambers 116 are formed to have the same level as that of the lower surface of the manifold 117. When a part of the manifold is formed to have the same level as that of the pressure chambers as described above, it is possible to thin the thickness of the ink-jet head.

The first and second embodiments and modifications thereof, and the second embodiment described above are examples of applying the present invention to an ink-jet head and an ink-jet printer, but the present invention can also be applied to other liquid ejecting apparatus which eject liquids other than ink. For instance, the present invention can be applied to various liquid ejecting apparatus which are used when a conductive paste is ejected to form a wiring pattern on a substrate, or when an organic light-emitting material is ejected onto a substrate to form an organo-electroluminescent display, or when an optical resin is ejected onto a substrate to form an optical waveguide or other such optical device.

What is claimed is:

1. A liquid ejecting apparatus, comprising:

a common liquid chamber;

a plurality of pressure chambers disposed along a plane;

a plurality of nozzle which eject liquid;

a plurality of individual liquid channels which extend from the common liquid chamber through the pressure chambers to the nozzles; and an actuator which is disposed so as to face the plurality of pressure chambers to selectively vary a volume of the plurality of pressure chambers, wherein the common liquid chamber is disposed on a side opposite to the nozzles with respect to the actuator such that the nozzles face downward, and that the common liquid chamber is disposed above the nozzle and the pressure chambers, and the actuator has a plurality of first through-holes each of which forms a part of a corresponding one of the individual liquid channels.

2. The liquid ejecting apparatus according to claim 1, wherein the actuator extends along the plane.

3. The liquid ejecting apparatus according to claim 1, wherein the common liquid chamber, as viewed in a direction perpendicular to the plane, is disposed in a region which overlaps the nozzles and the pressure chambers.

4. The liquid ejecting apparatus according to claim 1, wherein the actuator has a vibration plate disposed over the plurality of pressure chambers, a piezoelectric layer disposed on a side of the vibration plate opposite to the pressure chambers, and a plurality of individual electrodes each disposed corresponding to one of the plurality of pressure chambers on the side of the vibration plate opposite to the pressure chambers.

5. The liquid ejecting apparatus according to claim 1, wherein the piezoelectric layer is provided over the plurality of pressure chambers, each of the first through-holes includes a through-hole formed in the piezoelectric layer by which the common liquid chamber and one of the pressure chambers are communicated, and a protective film which prevents liquid from permeating the piezoelectric layer is formed on an inner surface of the through-hole included in each of the first through-holes.

6. The liquid ejecting apparatus according to claim 1, wherein the nozzles face downward, and the common liquid chamber is disposed above the nozzles.

7. The liquid ejecting apparatus according to claim 1, wherein through-holes are formed in the actuator by which the pressure chambers and the nozzles are communicated.

8. The liquid ejecting apparatus according to claim 1, wherein a through-hole is formed in the actuator by which the pressure chambers and the nozzles are communicated.

9. The liquid ejecting apparatus according to claim 1, further comprising a nozzle plate in which the nozzles are formed, wherein the nozzle plate, the pressure chambers, the actuator, and the common liquid chamber are disposed in this order in an up-down direction.

10. The liquid ejecting apparatus according to claim 1, further comprising a nozzle plate in which the nozzles are formed, wherein the nozzle plate, the actuator, the pressure chambers, and the common liquid chamber are disposed in this order in an up-down direction.

11. A liquid ejecting apparatus comprising, a common liquid chamber;

a plurality of pressure chambers disposed along a plane;

a plurality of nozzles which eject liquid;

a plurality of individual liquid channels which extend from the common liquid chamber through the pressure chambers to the nozzles; and an actuator which is disposed so as to face the plurality of pressure chambers to selectively vary a volume of the plurality of pressure chambers, wherein the common liquid chamber is disposed on a side opposite to the nozzles with respect to the actuator, the actuator has a plurality of first through-holes each of which forms a part of a corresponding one of the individual liquid channels, the actuator has a vibration plate disposed over the plurality of pressure chambers, a piezoelectric layer disposed on a side of the vibration plate opposite to the pressure chambers, and a plurality of individual electrodes each disposed corresponding to one of the plurality of pressure chambers on the side of the vibration plate opposite to the pressure chambers, and the common liquid chamber is disposed on a side opposite to the pressure chambers with respect to the actuator, a protective plate which protects the actuator is provided between the piezoelectric layer and the common liquid chamber; and the protective plate has a second through-hole which forms a part of the individual liquid channels.

12. The liquid ejecting apparatus according to claim 11, wherein the protective plate has a thick-walled portion which is joined to the actuator, and a thin-walled portion which is apart from the actuator, and the thin-walled portion is disposed to form a space between the thin-walled portion and a portion of the actuator which faces the pressure chambers.

13. The liquid ejecting apparatus according to claim 12, wherein the thin-walled portion of the protective plate functions as a damper which absorbs pressure fluctuation in the common liquid chamber.

14. The liquid ejecting apparatus according to claim 13 wherein the thin-walled portion of the protective plate constructs a part of inner walls of the common liquid chamber.

15. The liquid ejecting apparatus according to claim 13, wherein the thin-walled portion is formed continuously, over the plurality of pressure chambers.

16. The liquid ejecting apparatus according to claim 11, wherein the actuator has a common electrode which sandwiches the piezoelectric layer between the common electrode and the plurality of individual electrodes on the side of the vibration plate opposite to the pressure chambers, the common electrode extends continuously, over the plurality of individual electrodes, and a first channel formation hole which constructs a part of the through-hole is formed in the common electrode.

17. The liquid ejecting apparatus according to claim 11, wherein the piezoelectric layer includes piezoelectric portions which are provided individually corresponding to each of the plurality of pressure chambers, and the piezoelectric portions corresponding to each of the pressure chambers are accommodated between the vibration plate and the protective plate while being isolated from the individual liquid channels.

18. A liquid ejecting apparatus, comprising:

a plurality of nozzles which eject liquid;

a nozzle plate in which the nozzles are formed;

a plurality of pressure chambers disposed along a plane which communicate with the nozzles;

a common liquid chamber which is common to the pressure chambers; and piezoelectric layer which selectively varies a volume of the pressure chambers and which is provided over the plurality of pressure chambers, wherein the common liquid chamber and the piezoelectric layer are disposed on a side opposite to the nozzles with respect to the pressure chambers, the nozzle plate, the pressure chambers, the piezoelectric layer, and the common liquid chamber are disposed in this order in a direction of polarization of the piezoelectric layer, and a plurality of through-holes are formed in the piezoelectric layer through each of which the common liquid chamber and corresponding one of the pressure chambers are communicated.

19. The liquid ejecting apparatus according to claim 18 further comprising a vibration plate which covers the plurality of pressure chambers, wherein through holes are formed in the vibration plate by which the pressure chambers and the nozzles are communicated.

20. The liquid ejecting apparatus according to claim 18 further comprising a vibration plate which covers the plurality of pressure chambers, wherein a through-hole is formed in the vibration plate by which the common liquid chamber and the pressure chambers are communicated.

21. The liquid ejecting apparatus according to claim 18 wherein all of the plurality of pressure chambers are located in a region in which the common liquid chamber is formed.

22. An ink-jet printer which performs recording by ejecting ink onto a recording medium, comprising an ink-jet head which ejects ink onto the recording medium, wherein the ink-jet head has a common ink chamber, a plurality of pressure chambers disposed along a plane, a plurality of nozzles which eject the ink, a plurality of individual ink channels which extend from the common ink chamber through the pressure chambers to the nozzles, and an actuator which is disposed so as to face the plurality of pressure chambers to selectively vary a volume of the plurality of pressure chambers; and the common ink chamber is disposed on a side opposite to the nozzles with respect to the actuator such that the nozzles face downward, and the common ink chamber is disposed above the nozzles, the actuator and the pressure chambers, and as viewed in a direction perpendicular to the plane, the common ink chamber is disposed in a region which overlaps the pressure chambers, and the individual ink channels are formed to penetrate the actuator.

* * * * *